US008096224B2

(12) United States Patent
Martin et al.

(10) Patent No.: US 8,096,224 B2
(45) Date of Patent: Jan. 17, 2012

(54) COMPOSITE ARMOR INCLUDING GEOMETRIC ELEMENTS FOR ATTENUATING SHOCK WAVES

(75) Inventors: Curtis A. Martin, Damascus, MD (US); Gilbert F. Lee, Greenbelt, MD (US); Jeffry J. Fedderly, Ellicott City, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/731,675

(22) Filed: Mar. 25, 2010

(65) Prior Publication Data

US 2010/0236393 A1 Sep. 23, 2010

Related U.S. Application Data

(62) Division of application No. 11/973,990, filed on Oct. 5, 2007, now Pat. No. 7,685,922.

(51) Int. Cl.
*F41H 5/00* (2006.01)

(52) U.S. Cl. ..... 89/36.02; 89/904; 89/906; 89/908; 89/917

(58) Field of Classification Search ..... 89/36.01, 89/36.02, 36.07, 36.08, 36.05, 36.09
See application file for complete search history.

(56) References Cited

U.S. PATENT DOCUMENTS

| | | | | |
|---|---|---|---|---|
| 4,186,648 | A * | 2/1980 | Clausen et al. | 89/36.02 |
| 5,435,889 | A * | 7/1995 | Dietrich | 216/63 |
| 5,738,925 | A * | 4/1998 | Chaput | 428/101 |
| 2009/0114083 | A1 * | 5/2009 | Moore et al. | 89/36.02 |

* cited by examiner

*Primary Examiner* — Michael Carone
*Assistant Examiner* — Daniel Troy
(74) *Attorney, Agent, or Firm* — Howard Kaiser

(57) ABSTRACT

The present invention's stratified composite material system of armor, as typically embodied, comprises a strike stratum and a backing stratum. The strike stratum includes elastomeric matrix material and inventive ceramic-inclusive elements embedded therein and arranged (e.g., in one or more rows and one or more columns) along a geometric plane corresponding to the front (initial strike) surface of the strike stratum. More rigid than the strike stratum, the backing stratum is constituted by, e.g., metallic (metal or metal alloy) material or fiber-reinforced polymeric matrix material. Some inventive embodiments also comprise a spall-containment stratum fronting the strike stratum. The inventive ceramic-inclusive elements geometrically describe any of various inventive modes, including: first mode, having a flat front face and a textured back face; second mode, having a pyramidal front section and a prismatoidal (especially, prismoidal, e.g., truncated pyramidal or prismatic) body section; hybrid mode, combining features of first and second modes.

6 Claims, 20 Drawing Sheets

241, 240
252, 352
200, 300

252, 352
241, 240
200, 300

241, 240
252, 352
200, 300

241, 240
A
300
251, 250
352

241, 240
252, 352
200, 300

252, 352
241, 240
200, 300

241, 240
252, 352
200, 300

200, 300
241, 240
251, 250
β
α
252

241, 240
251, 250
252, 352
200, 300

241, 240
251, 250
252, 352
200, 300

241, 240
252, 352
251, 250
200, 300

241, 240
252, 352
200, 300
251, 250

241, 240
200, 300
251, 250
252, 352

COMPOSITE ARMOR INCLUDING GEOMETRIC ELEMENTS FOR ATTENUATING SHOCK WAVES

CROSS-REFERENCE TO RELATED APPLICATIONS

This application is a divisional of U.S. nonprovisional patent application Ser. No. 11/973,990, filing date 5 Oct. 2007, now U.S. Pat. No. 7,685,922, issue date 30 Mar. 2010, hereby incorporated herein by reference, entitled "Composite Ballistic Armor Having Geometric Ceramic Elements for Shock Wave Attenuation," joint inventors Curtis A. Martin, Gilbert F. Lee, and Jeffry J. Fedderly.

This application is related to U.S. provisional patent application No. 60/998,459, filing date 5 Oct. 2007, hereby incorporated herein by reference, invention title "Ballistic Armor Methods, Systems and Materials," joint inventors Curtis A. Martin, Gilbert F. Lee, Jeffrey J. Fedderly, David E. Johnson, David P. Owen, Rodney O. Peterson, Philip J. Dudt, James A. Zaykoski, and Inna G. Talmy.

In addition, this application bears some relation to each of the following applications: U.S. nonprovisional patent application Ser. No. 11/973,999, filing date 5 Oct. 2007, hereby incorporated herein by reference, invention title "Ballistic Armor Methodology Using Low-Density Ceramic Material," joint inventors Curtis A. Martin, David E. Johnson, David P. Owen, Rodney O. Peterson, and Philip J. Dudt; U.S. nonprovisional patent application Ser. No. 12/286,285, filing date 26 Sep. 2008, invention title "Lightweight Ballistic Armor Including Non-Ceramic-Infiltrated Reaction-Bonded-Ceramic Composite Material," sole inventor Curtis A. Martin; U.S. nonprovisional patent application Ser. No. 12/287,161, filing date 6 Oct. 2008, invention title "Pressureless Sintering-Based Method for Making a Two-Phase Ceramic Composite Body," joint inventors Curtis A. Martin, James A. Zaykoski, and Inna G. Talmy.

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to armor methodologies that implement ceramic material, more particularly to armor methodologies that implement discrete ceramic elements in combination with non-ceramic material.

Current military armor applications include land vehicles, air vehicles (e.g., aircraft and rotorcraft), stationary structures, and personnel. Other applications of armor systems are less common but may become more prevalent in the future, including marine vehicles (e.g., ships), unmanned air vehicles, unmanned marine vehicles, and missiles. Generally, the weight of an armor system is most critical for personnel/personal (e.g., helmet or body) armor.

Various armor constructions and configurations have been disclosed involving utilization of ceramic material. See, e.g., the following U.S. patents, each of which is incorporated herein by reference: deWitt, U.S. Pat. No. 7,067,031 B2, issued 27 Jun. 2006, entitled "Process for Making A Ceramic Armor Plate"; Cohen, U.S. Pat. No. 6,860,186 B2, issued 1 Mar. 2005, entitled "Ceramic Bodies and Ballistic Armor Incorporating the Same"; Mohr et al., U.S. Pat. No. 6,792,843 B2, issued 21 Sep. 2004, entitled "Armor-Plating Composite"; Ghiorse et al., U.S. Pat. No. 6,601,497 B2, issued 5 Aug. 2003, entitled "Armor with In-Plane Confinement of Ceramic Tiles"; Shih et al., U.S. Pat. No. 6,532,857 B1, issued 18 Mar. 2003, entitled "Ceramic Array Armor"; Lyons, U.S. Pat. No. 6,332,390 B1, issued 25 Dec. 2001, entitled "Ceramic Tile Armor with Enhanced Joint and Edge Protection"; Lyons et al., U.S. Pat. No. 6,253,655 B1, issued 3 Jul. 2001, entitled "Lightweight Armor with a Durable Spall Cover"; Lyons, U.S. Pat. No. 6,009,789, issued 4 Jan. 2000, entitled "Ceramic Tile Armor with Enhanced Joint and Edge Protection."

The aforementioned Shih et al. disclose an armor system that includes an elastomeric matrix material and, encapsulated therein, plural ceramic tiles arrayed along a common surface and spaced apart from one another. The ceramic tiles disclosed by Shih et al. and others are characterized by a smooth and planar shape. In other words, ceramic tiles conventionally used for armor applications are even in thickness.

Ceramic armor material, as conventionally embodied, often fails when impacted by a projectile (e.g., a ballistic body such as small arms fire, or an explosive fragment such as shrapnel from a bomb blast). A recognized need in the armor-related arts is to improve the capability of a structure or structural component made of ceramic to withstand significant impact.

SUMMARY OF THE INVENTION

In view of the foregoing, it is an object of the present invention to provide a ceramic body that is suitable for use in an armor system and that is more impervious to projectile impact than are conventionally known ceramic bodies. A further object of the present invention is to provide an armor system that implements such superiorly impervious ceramic bodies.

A conventional ceramic element can fail for various reasons when subjected to projectile impact. One important failure mechanism involves the reflection of shock waves off of the back face of the conventional ceramic element; equivalently expressed, the shock waves reflect off of the interface between the conventional ceramic element's back face and the matrix material in which the conventional ceramic element is embedded. "Incident" shock waves, compressive in nature, are associated with the impact of the projectile on the ceramic tile. "Reflected" shock waves, tensile in nature, are associated with the reflection of the incident shock waves from the rear surface of the conventional ceramic element. The complex interaction of the incident shock waves and the reflected shock waves results in internal failure of the conventional ceramic element.

This kind of destructive interaction of incident and reflected shock waves is particularly marked in a conventional ceramic element because of the evenly thick geometry of the conventional ceramic element, commonly referred to as a ceramic "tile." In a conventional ceramic element, the incident shock waves and the reflected shock waves each describe approximately planar patterns of propagation. The incident shock waves and the reflected shock waves tend to coincide both spatially and temporally, encountering each other so as to be concentrated in one or more approximately planar areas in the interior of the ceramic element. The high energy density characterizing each of these planar levels of shock wave concentration brings about failure of the ceramic material.

The present invention provides new and improved geometric shapes for ceramic elements. Disclosed herein are inventive ceramic elements of various shapes that are suitable for inclusion in armor material systems. Uniquely featured by an inventive ceramic element is a geometrically uneven character that results in attenuation of interaction between the incident shock waves and the reflected shock waves within the inventive ceramic element.

A fundamental feature of the present invention—regardless of whether according to "first-mode," "second-mode," or "hybrid-mode" inventive practice—is the non-parallelism of the front and back surfaces, or portions thereof, of the inventive ceramic element. Inventively prescribed textures and/or shapes impart front-and-back non-parallelism to the present invention's ceramic elements. When an inventive ceramic element is impacted by a projectile, the non-parallel character of the front and back faces, relative to each other, tends to reduce both the spatial coincidence and the temporal coincidence, and hence the deleterious effects, of the interactions between the incident shock waves and the reflected shock waves.

A conventional ceramic element typically has a flat parallelepiped or plate-like shape, with smooth and planar front and back faces that are parallel to each other. Upon impact by a projectile upon a conventional ceramic element, the resultant incident shock waves (commencing at the front face and generally directed toward the back face) and the consequent reflected shock waves (commencing at the back face and generally directed toward the front face) tend to meet each other inside the conventional ceramic element. Because of the relatively great number and intensities of these encounters between incident and reflected shock waves within the conventional ceramic element, the probability is relatively high of significant fracture of the conventional ceramic element.

In contrast, an inventive ceramic element is characterized by non-parallelism of the front and back faces. Upon impact by a projectile upon an inventive ceramic element, the resultant incident shock waves (commencing at the front face and generally directed toward the back face) and the consequent reflected shock waves (commencing at the back face and generally directed toward the front face) tend to both temporally and spatially diverge and thereby tend to avoid each other inside the conventional ceramic element. The reflected shock waves are incident shock waves that reflect from the back face; equivalently expressed, the reflected shock waves are incident shock waves that reflect from the interface between the back face and the matrix material in which the inventive ceramic element is embedded. Because of the relatively small number and intensities of these encounters between incident and reflected shock waves within the inventive ceramic element, the probability is relatively low of significant fracture of the inventive ceramic element. The sizes and shapes of the inventive ceramic elements are to some extent dictated by the threat(s) intended to be stopped by the inventive armor system.

By virtue of its unique geometric shape, an inventive ceramic element can control the propagation of shock waves associated with impact by a projectile. When an inventive ceramic element is impacted by a projectile, the inventive ceramic element controls the propagation of shock waves both within and behind the elastomeric matrix layer in which the inventive ceramic element is embedded. The inventive ceramic element slows down the propagation of shock wave energy so that, to the extent that the shock wave energy passes through the ceramic-embedded elastomeric matrix layer and reaches the backing layer (which is adjacent to and behind the ceramic-embedded elastomeric matrix layer), the backing layer is less susceptible to tearing or breaking.

Generally speaking, a backing in an armor system that is subjected to projectile impact fails upon the occurrence of either or both of the following circumstances: (i) the shock wave energy is so great that the backing cannot strain to a sufficient extent; (ii) the shock wave energy is so rapid (e.g., the backing is "pushed" so quickly) that the backing cannot strain at a sufficient rate. When the present invention's composite armor system, as typically embodied, is subjected to projectile impact, the time delay and reduced intensity of the shock waves that reach the backing permit the backing to sufficiently adapt, adjust and/or recover so to remain intact or at least substantially so.

As typically embodied, the present invention's layered composite material system of armor comprises a strike layer and a backing layer. The strike layer includes elastomeric matrix material and plural inventive ceramic-inclusive elements. The inventive ceramic-inclusive elements are embedded in the elastomeric matrix material and are arranged (e.g., in one or more rows and one or more columns) along a geometric plane corresponding to the front surface (initial strike surface) of the strike layer. More rigid than the strike layer, the backing layer is made of a rigid material such as a metallic (metal or metal alloy) material or a fiber-reinforced polymeric matrix material. Some inventive embodiments further comprise a spall-containment layer fronting the strike layer. The inventive ceramic-inclusive elements are geometrically configured in any of three inventive modes. The first inventive mode of ceramic-inclusive element has a flat front face and a textured back face. The second inventive mode of ceramic-inclusive element has a pyramidal front section and a prismatoidal (especially, prismoidal, e.g., truncated pyramidal or prismatic) body section. The hybrid mode of ceramic-inclusive element combines the textured back face geometry of the first inventive mode with the combined pyramidal-prismatoidal geometry of the second inventive mode.

Generally speaking, geometric terms used herein are defined as they are conventionally understood.

A "polyhedron" is a three-dimensional figure all of the faces (sides) of which are polygons.

A "prismatoid" is a polyhedron all of the vertices of which lie in one of two parallel planes. Types of prismatoids include pyramids and prismoids. Types of prismoids include pyramidal frustums and prisms.

A "pyramid" is a prismatoid having a polygonal base and at least three triangular faces that meet at a common point ("vertex" or, synonymously, "apex"). The apex, which is the common point of the triangular faces of a pyramid, lies in a first parallel plane of the pyramidal prismatoid; the polygonal base lies in a second parallel plane of the pyramidal prismatoid.

A "cone" is a geometric figure having a round (circular, elliptical, or oval) base, a vertex situated outside the plane of the base, and a continuously curved side narrowing to an apex (vertex). Geometrically speaking, a cone bears some analogy to a pyramid.

A "prismoid" is a prismatoid having two polygonal bases that have an equal number of sides. One polygonal bases lies in a first parallel plane of the pyramidal prismatoid; the other polygonal base lies in a second parallel plane of the pyramidal prismatoid. The lateral faces of a prismoid are quadrilaterals.

A "pyramidal frustum" (synonymously, "frustum of a pyramid") is a prismoid the two polygonal bases of which are geometrically similar (but not geometrically congruent). Equivalently expressed, a pyramidal frustum is a "truncated pyramid," i.e., a pyramid that is cut/sliced off below the apex along a plane parallel to the polygonal base of the pyramid. A pyramidal frustum can also be described as a "tapered prism," i.e., a prism-like figure that is tapered (gradually decreases in size) from one polygonal base to the other polygonal base.

The terms "truncated pyramid" and "tapered prism" are used synonymously herein with the term "pyramidal frustum." A pyramidal frustum has a polygonal base and at least three trapezoidal faces that meet at the other polygonal base.

A "conical frustum" is a geometric figure that is a "truncated cone," i.e., a cone that is cut/sliced off below the apex along a plane parallel to the round base of the cone. The terms "conical frustum," "frustum of a cone", and "truncated cone" are used synonymously herein. Geometrically speaking, a truncated cone bears some analogy to a truncated pyramid.

A "prism" is a prismoid the two polygonal bases of which are geometrically congruent. In other words, the two polygonal bases (which can also be referred to as the "ends" of the prism) are exactly the same size and shape, and the prism is the identical size and shape all the way through from one polygonal base to the other polygonal base. At least three parallelogram faces join the two polygonal bases.

The term "right" is used herein to describe terms such as "prismatoid," "prismoid," "pyramid," "pyramidal frustum," "cone," "conical frustum," and "prism." The term "right" when used in such contexts connotes that a prismatoid is characterized, or approximately or generally characterized, by a geometric axis of symmetry, and that the axis is perpendicular to the one polygonal base (in the case of a pyramid) or the two polygonal bases (in the cases of a pyramidal frustum and a prism, each of which is a prismoid). All of the faces of a right prism are perpendicular to the polygonal bases.

A "regular pyramid" is a pyramid in which the polygonal base is a regular polygon. Similarly, a "regular prismoid" (e.g., "regular pyramidal frustum" or "regular prism") is a prismoid in which the polygonal bases are regular polygons. A "regular polygon is a polygon all of the sides of which are equal length and all of the angles of which are equal size. Examples of regular polygons are regular triangles, regular quadrilaterals (parallelograms or rectangles), regular pentagons, regular hexagons, regular heptagons, regular octagons, etc.

Other objects, advantages and features of the present invention will become apparent from the following detailed description of the present invention when considered in conjunction with the accompanying drawings.

BRIEF DESCRIPTION OF THE DRAWINGS

The present invention will now be described, by way of example, with reference to the accompanying drawings, wherein like numbers indicate same or similar parts or components, and wherein:

FIG. 1 is representative of inventive first-mode embodiments having a flat front face and either a one-dimensionally textured back face or a two-dimensionally textured back face.

FIG. 4 is representative of inventive first-mode embodiments having a flat front face and either a one-dimensionally textured back face or a two-dimensionally textured back face.

FIG. 7 is representative of inventive first-mode embodiments having a flat front face and either a one-dimensionally textured back face or a two-dimensionally textured back face.

FIG. 10 is representative of inventive first-mode embodiments having both a textured front face and a textured back face, wherein both faces are either one-dimensionally textured or two-dimensionally textured. FIG. 11 through FIG. 13 are representative of inventive first-mode embodiments having a flat front face and either a one-dimensionally textured back face or a two-dimensionally textured back face.

FIG. 18 is representative of inventive second-mode embodiments having a pyramidal front face, a tapered prismatic body, and a flat back face.

FIG. 30 is representative of inventive second-mode embodiments having a pyramidal front face, an "invertedly tapered" prismatic body, and a flat back face.

FIG. 31 is representative of inventive hybrid-mode embodiments having a pyramidal front face, a tapered prismatic body, and a textured (one-dimensionally or two-dimensionally) back face.

FIG. 18 is representative of inventive second-mode embodiments having a pyramidal front face, a non-tapered prismatic body, and a flat back face.

FIG. 33 is representative of inventive second-mode embodiments having a pyramidal front face, a regular (non-tapered) prismatic body, and a textured (two-dimensionally or three dimensionally) back face.

FIG. 50 is partial and enlarged and is sans ceramic elements for illustrative purposes.

DETAILED DESCRIPTION OF THE INVENTION

Figure 1:
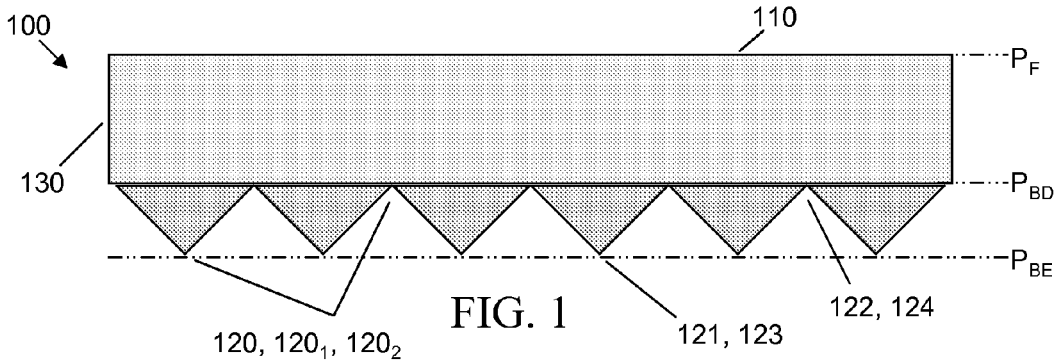
FIG. 1 is a side view of a first-mode geometric ceramic element in accordance with the present invention.

Referring now to FIG. 1 through FIG. 17, inventive first-mode ceramic element 100 includes a front face 110, a back face 120, and four side faces 130. Front face 110 is referred to herein as the "front" surface of inventive first-mode ceramic element 100, in accordance with how an inventive material armor system that includes plural front faces 110 is typically configured. That is, a projectile that penetrates such an inventive material armor system will make initial contact with an inventive ceramic element 100 at its front face 110; in other words, front face 110 is the "strike face" or "strike surface." In real-world inventive armor applications the projectile threats may take any of a variety of forms, including but not limited to firearm projectiles (such as bullet 45 generically depicted in FIG. 42 and FIG. 43) or fragmentation projectiles (such as fragment 45 generically depicted in FIG. 54).

According to typical first-mode inventive practice, front face 110 is flat. The term "flat," as used herein to describe a surface, means at least approximately smooth (even) and level so as to at least substantially lie in a geometric plane. A flat surface manifests itself in two dimensions, e.g., length and width. Also according to typical first-mode inventive practice, as distinguished from front face 110, back face 120 is not flat. A non-flat surface manifests itself in three dimensions, e.g., length, width and height.

As shown in FIG. 1 through FIG. 17, back face 120 is characterized by a kind of non-flatness, namely, texture. The term "textured," as used herein to describe a surface, means characterized by elevations (elevated or raised surface portions) and depressions (depressed or recessed surface portions). Inventive first-mode practice can involve either one-dimensional texturing, or two-dimensional texturing, of back face 120.

Figure 6:
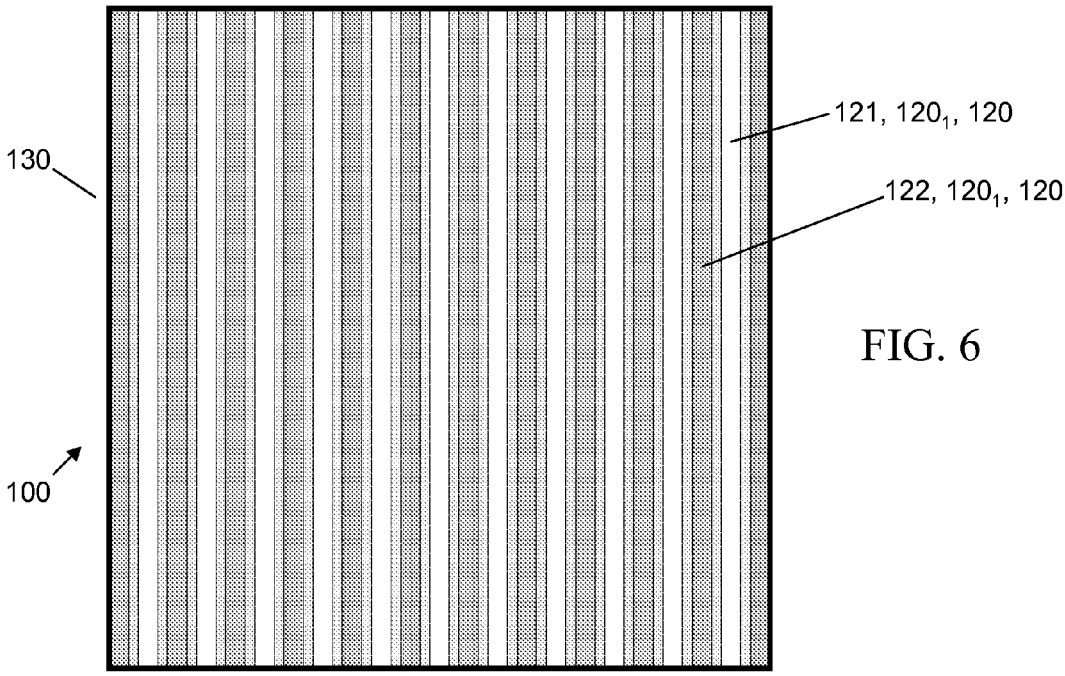
FIG. 6 is a back view of the inventive first-mode geometric ceramic element shown in FIG. 4, wherein the inventive first-mode geometric ceramic element has a one-dimensionally textured back face.
Figure 9:
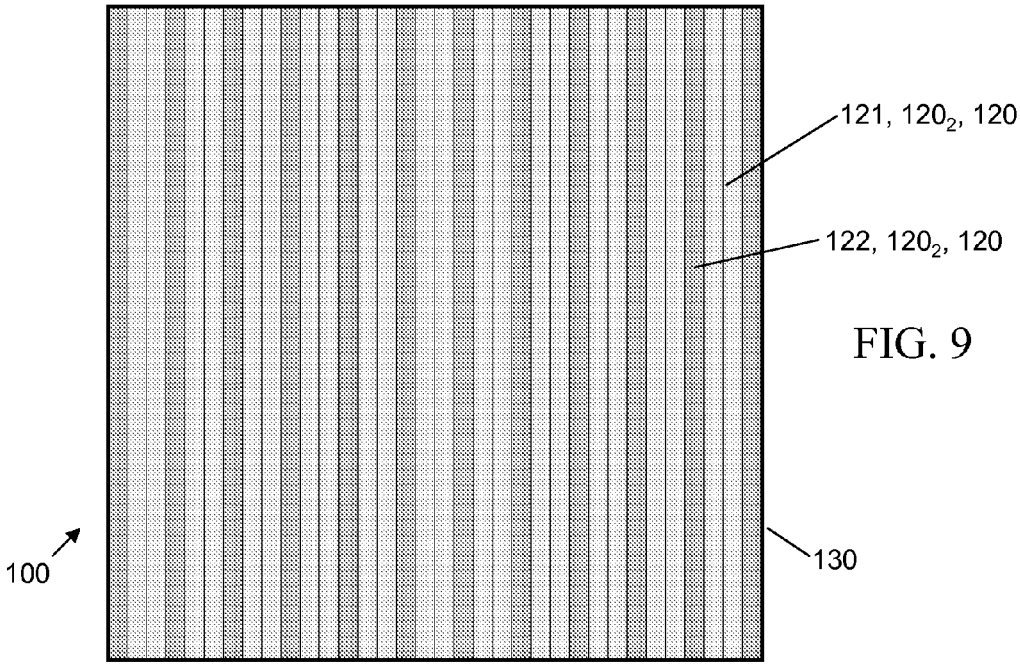
FIG. 9 is a back view of the inventive first-mode geometric ceramic element shown in FIG. 7, wherein the inventive first-mode geometric ceramic element has a one-dimensionally textured back face.

Examples of a one-dimensionally textured back face $\mathbf{120}_1$ are shown in plan view in FIG. 6 and FIG. 9. The term "one-dimensionally textured," as used herein to describe a surface, means textured so as to form a pattern of elevations and depressions that are linear, parallel, and varying (e.g., alternating), such as a pattern of ridges (e.g., crests) and grooves (e.g., channels, furrows). A one-dimensionally textured face exhibits a two-dimensional (e.g., height, and either length or width) architecture. A one-dimensionally textured surface is characterized by non-uniform height in one of the two in-plane dimensions, e.g., either the length or the width of the surface.

Figure 3:
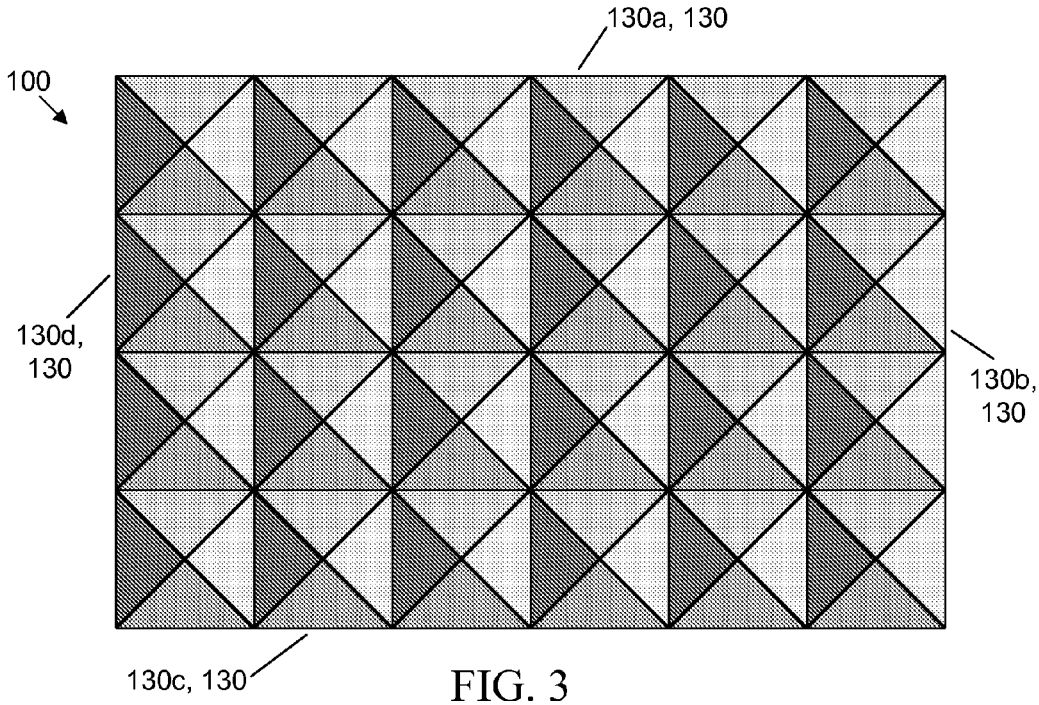
FIG. 3 is a back view of the inventive first-mode geometric ceramic element shown in FIG. 1, wherein the inventive first-mode geometric ceramic element has a two-dimensionally textured back face.
Figure 5:
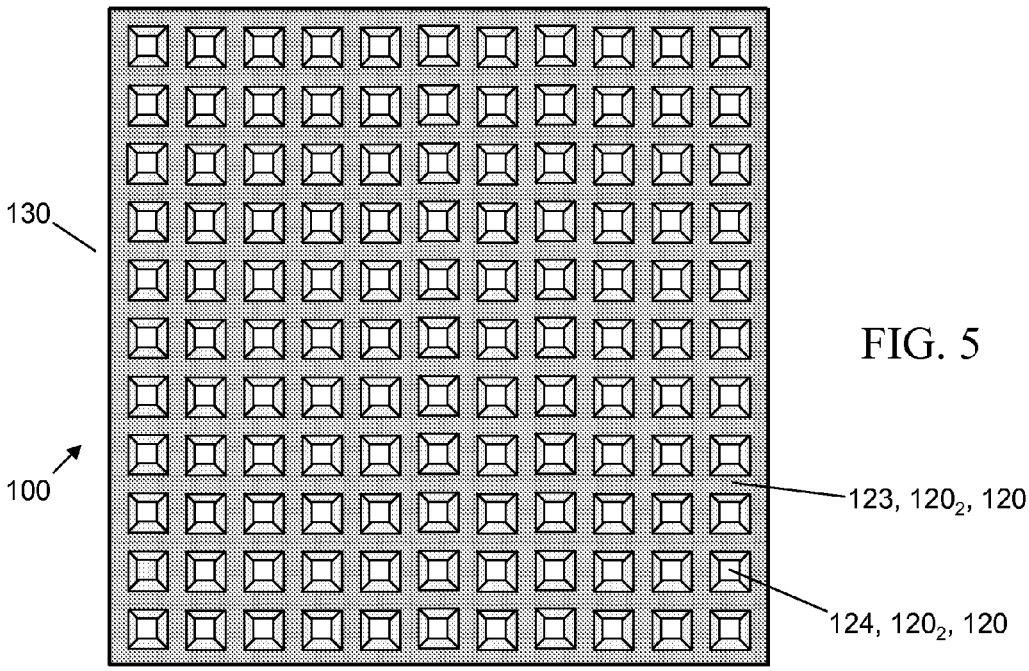
FIG. 5 is a back view of the inventive first-mode geometric ceramic element shown in FIG. 4, wherein the inventive first-mode geometric ceramic element has a two-dimensionally textured back face.
Figure 8:
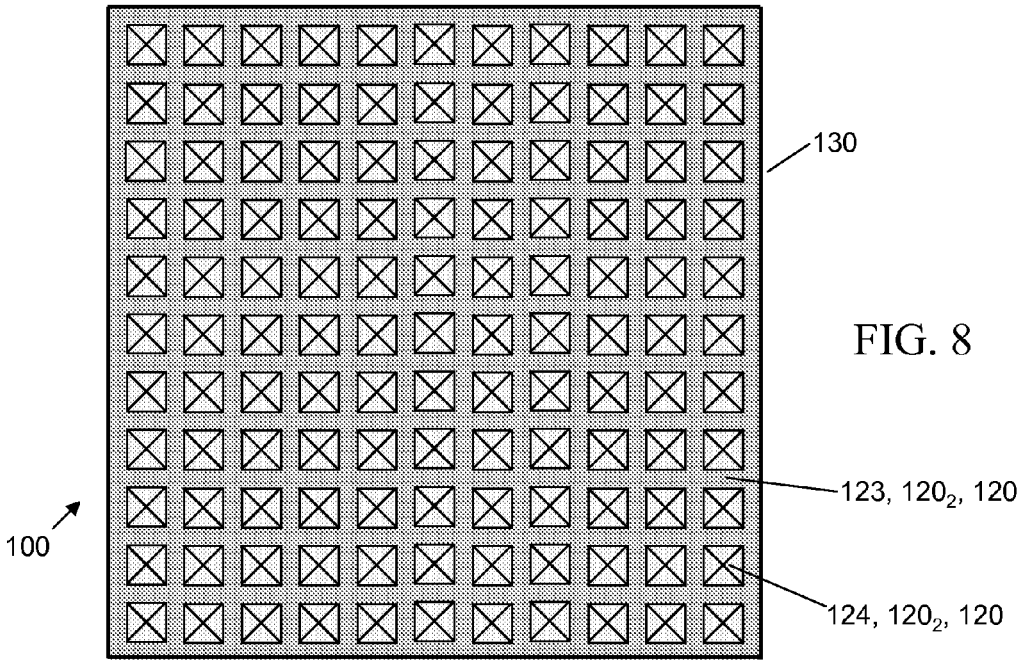
FIG. 8 is a back view of the inventive first-mode geometric ceramic element shown in FIG. 7, wherein the inventive first-mode ceramic element has a two-dimensionally textured back face.

Examples of a two-dimensionally textured back face $\mathbf{120}_2$ are shown in plan view in FIG. 3, FIG. 5 and FIG. 8. The term "two-dimensionally textured," as used herein to describe a surface, means textured so as to form a pattern of elevations and depressions that are linearly arrayed in each of two in-plane directions (e.g., perpendicular in-plane directions), such as a pattern of protuberances (e.g., projections, peaks, bumps) and indentations (e.g., valleys, dimples, pits). A "two-dimensionally textured" face exhibits a three-dimensional (e.g., height, length, and width) architecture. A two-dimensionally textured surface is characterized by non-uniform height in both in-plane dimensions, e.g., both the length and the width of the surface.

The profile views shown in FIG. 1, FIG. 2, FIG. 4, FIG. 7, FIG. 10, FIG. 11, FIG. 12 and FIG. 13 can each be considered to be representative of either a one-dimensionally textured back face $\mathbf{120}_1$ or a two-dimensionally textured back face $\mathbf{120}_2$. For instance, the profile views of FIG. 1 and FIG. 2 can be understood to represent either a one-dimensionally textured back face $\mathbf{120}_1$, or a two-dimensionally textured back face $\mathbf{120}_2$ such as shown in FIG. 3. The profile view of FIG. 4 can be understood to represent either a one-dimensionally textured back face $\mathbf{120}_1$ such as shown in FIG. 6, or a two-dimensionally textured back face $\mathbf{120}_2$ such as shown in FIG. 5. The profile view of FIG. 7 can be understood to represent either a one-dimensionally textured back face $\mathbf{120}_1$ such as shown in FIG. 9, or a two-dimensionally textured back face $\mathbf{120}_2$ such as shown in FIG. 8.

A one-dimensionally textured surface describes variation in height in one direction. According to typical inventive practice, a one-dimensionally textured back face $\mathbf{120}_1$ describes a pattern of ridges 121 and grooves 122 that are parallel to and alternate with each other (e.g., ridge-groove-ridge-groove-ridge-groove, etc.).

Figure 2:
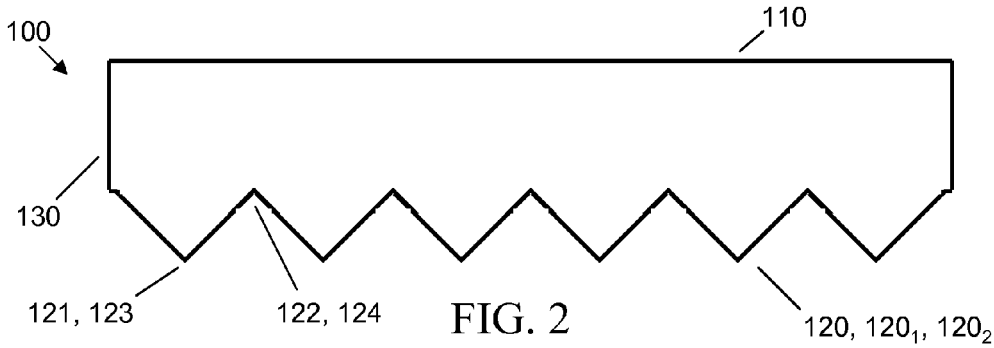
FIG. 2 is cross-sectional side view, corresponding to the side view shown in FIG. 1, of the inventive first-mode geometric ceramic element shown in FIG. 1.
Figure 4:
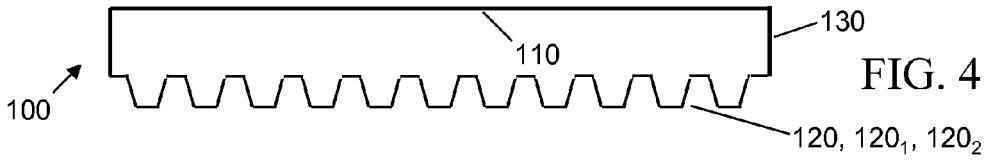
FIG. 4 is a cross-sectional side view of another first-mode geometric ceramic element in accordance with the present invention.
Figure 7:
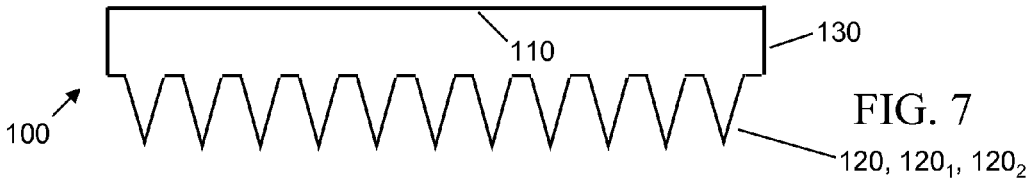
FIG. 7 is a cross-sectional side view of another first-mode geometric ceramic element in accordance with the present invention.
Figure 10:
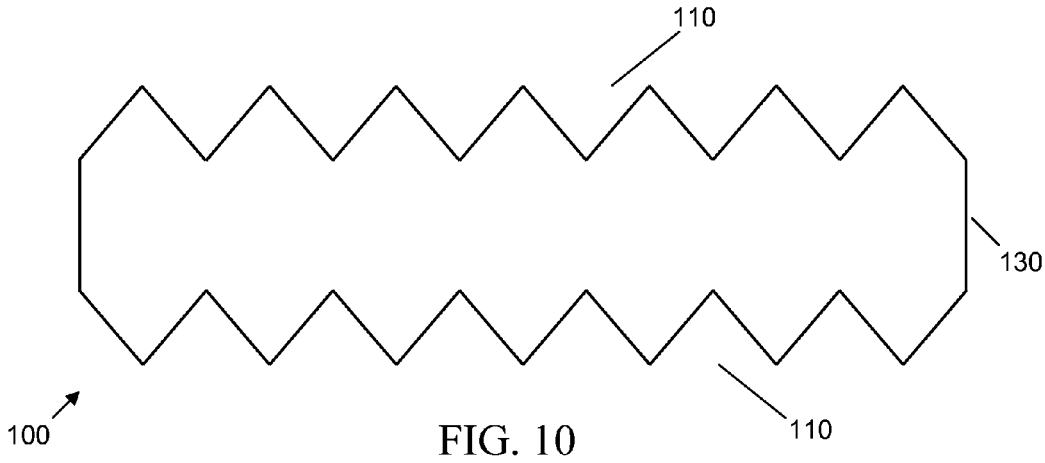
FIG. 10 through FIG. 13 are cross-sectional side views of various other geometric first-mode ceramic elements in accordance with the present invention.
Figure 11:
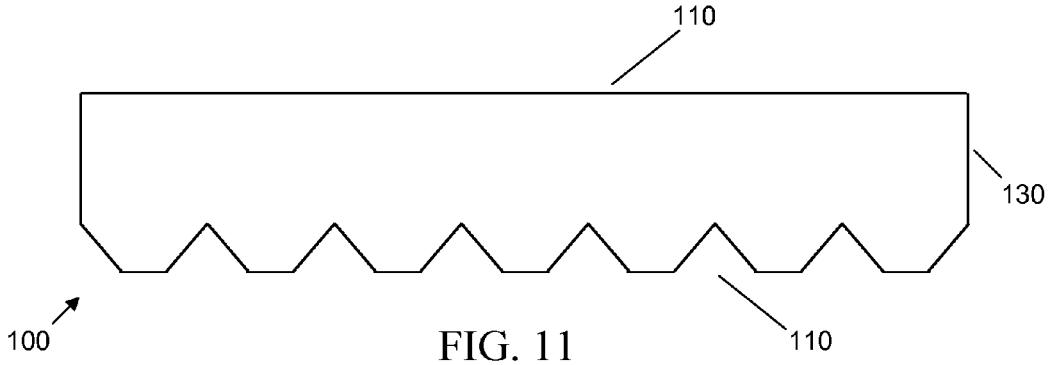
Figure 12:
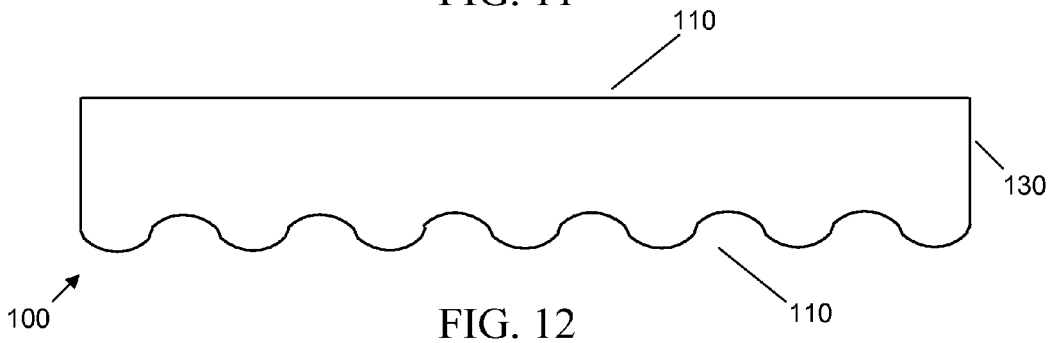

Examples of a one-dimensionally textured back face $\mathbf{120}_1$ include, but are not limited to: triangular ridges and triangular grooves, such as shown in FIG. 1, FIG. 2, and FIG. 10; truncated triangular ridges (having a trapezoidal cross-section) and truncated triangular grooves (having a trapezoidal cross-section), such as shown in FIG. 4 and FIG. 6; triangular ridges and truncated triangular grooves (having a trapezoidal cross-section), such as shown in FIG. 7 and FIG. 9; truncated triangular ridges (having a trapezoidal cross-section) and triangular grooves, such as shown in FIG. 11; curved/curvilinear ridges and curved/curvilinear grooves, such as shown in FIG. 12.

A two-dimensionally textured back face $\mathbf{120}_2$ describes variation in height in two perpendicular directions. According to typical inventive practice, a two-dimensionally textured back face $\mathbf{120}_2$ describes an array of protuberances 123 and indentations 124. For instance, many inventive embodiments of two-dimensionally textured back face $\mathbf{120}_2$ having an arrangement of protuberances 123 and indentations 124 in parallel rows and perpendicular columns (i.e., wherein parallel columns are perpendicular to parallel rows), thus describing a kind of "egg crate" pattern.

Examples of a two-dimensionally textured back face $\mathbf{120}_2$ surface include, but are not limited to: adjacent rows and columns of pyramidal protuberances, each having four triangular sides and a rectangular (e.g., square) base, such as shown in FIG. 1, FIG. 2, and FIG. 3; slightly separated rows and columns of truncated pyramidal protuberances, each having four trapezoidal sides, a rectangular (e.g., square) top, and a rectangular (e.g., square) base, such as shown in FIG. 4 and FIG. 5; slightly separated rows and columns of pyramidal protuberances each having four triangular sides and a rectangular (e.g., square) base, such as shown in FIG. 7 and FIG. 8; adjacent rows and columns of truncated pyramidal protuberances each having four trapezoidal sides, a rectangular (e.g., square) top, and a rectangular (e.g., square) base, such as shown in FIG. 11; rows and columns of curved/curvilinear protuberances, such as shown in FIG. 12.

Both one-dimensionally textured back faces $\mathbf{120}_1$ and two-dimensionally textured back faces $\mathbf{120}_2$ are characterized by elevated surface areas and depressed surface areas. The present invention's one-dimensionally textured back faces $\mathbf{120}_1$ typically have ridges 121 and grooves 122. The present invention's two-dimensionally textured back faces $\mathbf{120}_2$ typically have protuberances 123 and indentations 124. Inventive practice lends itself to wide latitude in configuring textured back faces $\mathbf{120}_1$ and $\mathbf{120}_2$.

Figure 17:
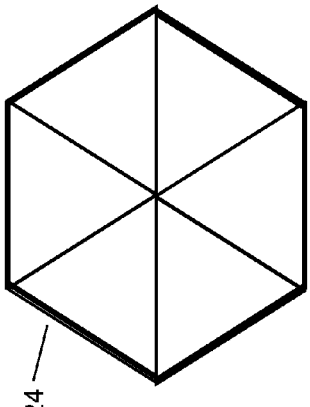
FIG. 15 through FIG. 17 are each a top plan view of an individual texture formation, each of which is suitable for repeated patterning so as to form the two-dimensionally textured back face of an inventive first-mode geometric ceramic element.
Figure 16:
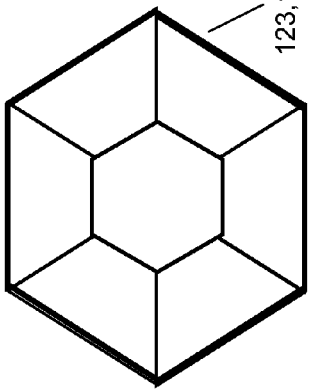
Figure 15:
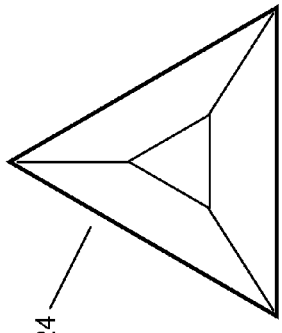
Figure 14:
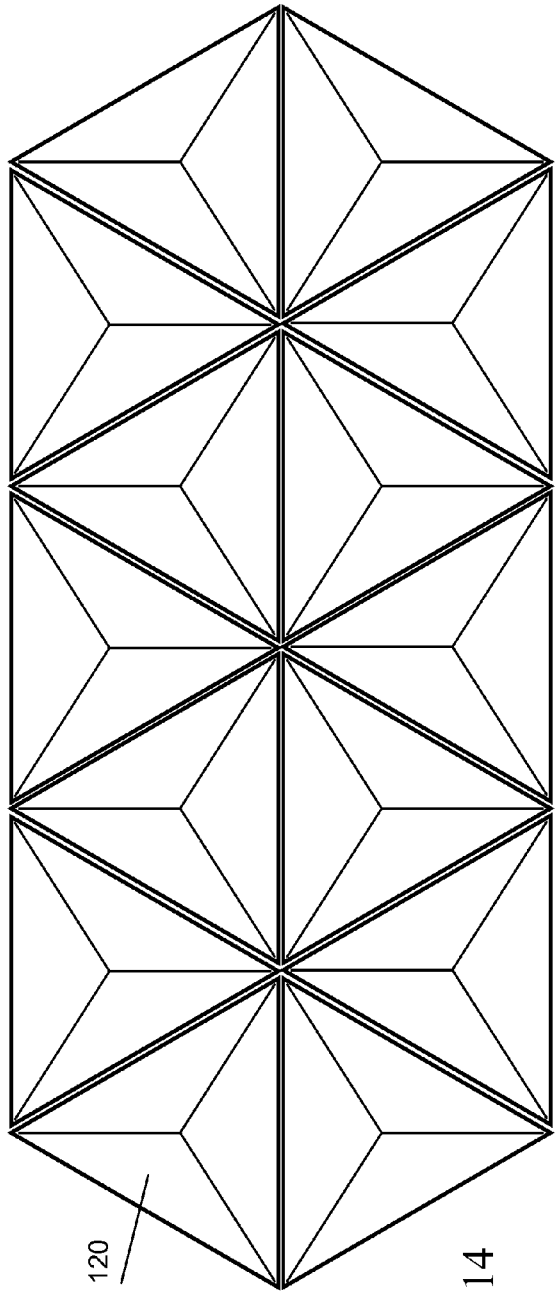
FIG. 14 is a partial back view of another inventive first-mode geometric ceramic element, wherein the inventive first-mode geometric ceramic element has a two-dimensionally textured back face.

Note, for instance, the diverse possible shapes of protuberances 123 and indentations 124 in an inventive two-dimensionally textured back faces $\mathbf{120}_2$, such as exemplified in FIG. 3 and FIG. 8 (quadrilateral pyramid with four triangular sides), FIG. 5 (truncated quadrilateral pyramid with four trapezoidal sides), FIG. 14 (triangular pyramid with three triangular sides), FIG. 15 (truncated triangular pyramid with three trapezoidal sides), FIG. 16 (truncated hexagonal pyramid with six trapezoidal sides), FIG. 17 (pyramid with six triangular sides). Each of these basically pyramidal shapes can be conceived as representing either a protuberance 123 or an indentation 124.

FIG. 1 through FIG. 3 and FIG. 11 portray depressed surface areas that are thin (linear or approximately linear). FIG. 3 can be conceived to be geometrically inverted so as to represent an inventive two-dimensionally textured back face $\mathbf{120}_2$ having adjacently arrayed pyramidal indentations, the elevated surfaces areas thus being linear or approximately so. FIG. 4 through FIG. 9 portray depressed surface areas that are thick (planar). FIG. 5 can be conceived to be geometrically inverted so as to represent an inventive two-dimensionally textured back face $\mathbf{120}_2$ having separately arrayed truncated pyramidal indentations, the elevated surfaces areas thus being planar.

Inventive first-mode practice usually provides an inventive ceramic element 100 having a flat front face 110 and a textured back face 120 corresponding to respective parallel geometric planes. As illustrated in FIG. 1, flat front face 110 is situated in a geometric plane $p_F$. Textured back face 120 is non-flat and hence, strictly speaking, cannot be considered to be situated in a geometric plane; however, textured back face 120 can be understood to describe a pattern of elevated and depressed surface areas in which the most depressed surface areas are situated in a geometric plane $p_{BD}$, or in which the most elevated surface areas are situated in a geometric plane $p_{BE}$. As shown in FIG. 1, geometric planes $p_F$, $p_{BD}$, and $p_{BE}$ are parallel to one another.

Although typical inventive practice provides for flatness of front face 110 and texturing of back face 120, the texturing (one-dimensional texturing and/or two-dimensional texturing) of both front face 110 and back face 120, such as depicted in FIG. 10, may serve to enhance the benefits of inventive practice in terms of the complex interactions of incident shock waves and reflected shock waves, such as discussed hereinbelow with reference to FIG. 47 through FIG. 49.

Figure 13:
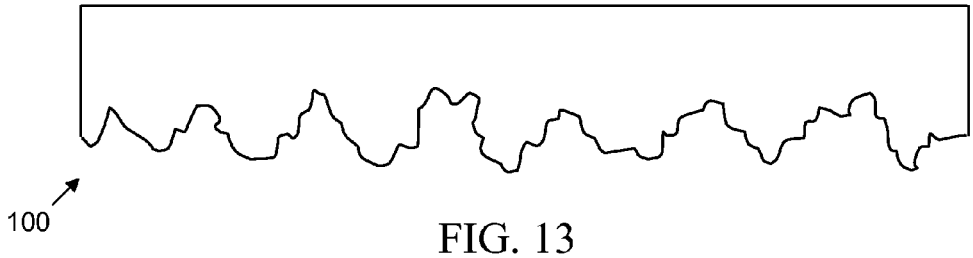

The present invention's back face 120 is normally embodied as having a regular pattern of elevations and depressions, regardless of whether the texture is one-dimensional or two-dimensional along the geometric plane of back face 120. Shown in FIG. 13 is an exception to the usual inventive first-mode practice of regularity of texturing of back face 120. The back face 120 shown in FIG. 13 manifests irregularity (e.g., randomness or fractalness) of its texturing, as there is no apparent configurative order to the elevated areas and the depressed areas. The irregularity illustrated in FIG. 13 can be understood to be representative of either two-dimensional texturing or three-dimensional texturing.

According to some inventive embodiments, the imparting of a fractal character to the texturing of back face 120 may prove particularly propitious in furthering the shock wave-ameliorative qualities of inventive practice. Fractal mathematics is well known, and various applications thereof have been disclosed in the public literature. See, e.g., Gipple et al. U.S. Pat. No. 6,663,803 B1 issued 16 Dec. 2003, entitled "Fabrication of a Fractally Attributively Delamination Resistive Composite Structure," incorporated herein by reference, and Gipple et al. U.S. Pat. No. 6,333,092 B1 issued 25 Dec. 2001, "entitled Fractal Interfacial Enhancement of Composite Delamination Resistance," incorporated herein by reference, which disclose composite laminate structures characterized by a fractal interfacial profile.

As exemplified in FIG. 3, FIG. 5, FIG. 6, FIG. 8 and FIG. 9, inventive first-mode ceramic element 100 has side faces 130, viz., 130*a*, 130*b*, 130*c*, and 130*d*. Generally, the geometric characteristics of the side faces are less important to inventive first-mode practice than are the geometric characteristics of the front and back faces. According to frequent inventive first-mode practice, the opposite side faces of an inventive first-mode ceramic element 100 are flat and parallel to each other, the inventive first-mode ceramic element 100 thus describing a rectangular (either square or non-square) plan form.

Nevertheless, depending on the inventive embodiment, an inventive first-mode ceramic element 100 can describe practically any plan form, curved and/or curvilinear and/or rectilinear—for instance, triangle, non-rectangular quadrilateral (e.g., trapezoid or parallelogram), polygon having five sides or greater, circle, oval (e.g., ellipse or ellipsoid or irregular oval), or some combination thereof. The plan form of an inventive first-mode ceramic element 100 is secondary to its elevation form, which entails the nature and degree of parallelism between its front face 110 and its back face 120, and which represents the primary inventive focus that improves the physical shock wave mechanism concomitant impacting thereof by a projectile such as a bullet, missile, or explosive fragment.

There is considerable variability in inventive first-mode practice as to how a textured back face 120 can be configured in terms of the sizes, shapes, and relationships (e.g., separations) of the elevated surface areas and depressed surface areas. Inventive first-mode practice admits of a variety of textures of inventive back face 120, both one-dimensionally textured back face $\mathbf{120}_1$ and two-dimensionally textured back face $\mathbf{120}_2$. Although two-dimensionally textured back face $\mathbf{120}_2$ is variously shown by way of example in FIG. 3, FIG. 5 and FIG. 8 to be regularly configured in horizontal and vertical rows and columns of elevated surface areas 123 and depressed surface areas 124, inventive practice is possible, for example, in which two-dimensionally textured back face $\mathbf{120}_2$ is regularly configured in diagonal or staggered rows and columns of elevated surface areas 123 and depressed surface areas 124, or in which two-dimensionally textured back face $\mathbf{120}_2$ is irregularly configured with elevated surface areas 123 and depressed surface areas 124.

Some inventive embodiments combine indicia of one-dimensional and two-dimensional texturing of back face 120, for instance by providing at least a first surface portion representing one-dimensionally textured back face $\mathbf{120}_1$ and at least a second surface portion representing two-dimensionally textured back face $\mathbf{120}_2$. The ordinarily skilled artisan who reads the instant disclosure will recognize that the present invention's textured back face 120 can be embodied as having any of multifarious textures other than those that are illustrated herein by way of example.

A practitioner of the present invention should base his/her selection of the values of the various geometric parameters (including scale, shape, and spacing) of the texture of back face 120 on consideration of the following factors, among others: the modulus of the material; the speed of the shock wave; and, the thickness of the inventive ceramic element 100. The texture of back face 120 is preferably designed such that the reflections of the incident shock waves will be disrupted because of the locally angled or curved surfaces, and such that the timings of the reflections will be dispersed because the incident shock waves will encounter back face 120 at locally different times as they progress through the textured region of back face 120. The overall result, when an inventively configured ceramic element 100 is impacted by a projectile, is a damping effect on the incident and reflected shock waves.

Figures 19, 20, 21, 22, 23, 24, 25, 26, 27, 28, 29, 30, 31:
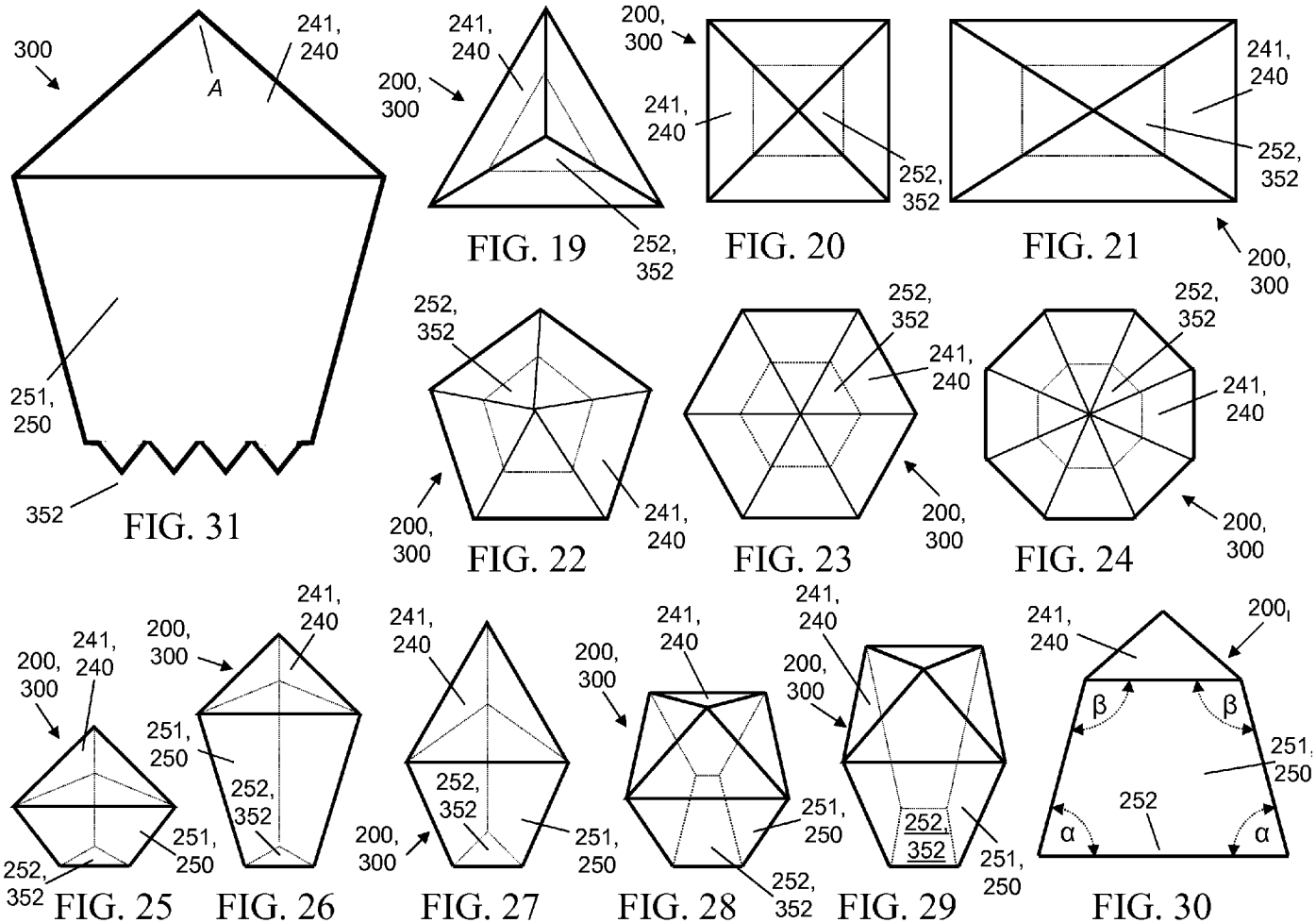
FIG. 19 through FIG. 29 are top plan views (FIG. 19 through FIG. 24) and perspective views (FIG. 25 through FIG. 30) of various inventive second-mode embodiments having a pyramidal front face, a tapered prismatic body, and a flat back face.
FIG. 30 is a side view of an inventive second-mode geometric ceramic element that manifests frontward (front-wise) tapering, as distinguished from the backward (back-wise) tapering manifested by inventive second-mode geometric ceramic elements such as illustrated in FIG. 19 through FIG. 29.
FIG. 31 is a side view of a hybrid-mode geometric ceramic element in accordance with the present invention.
Figure 32:
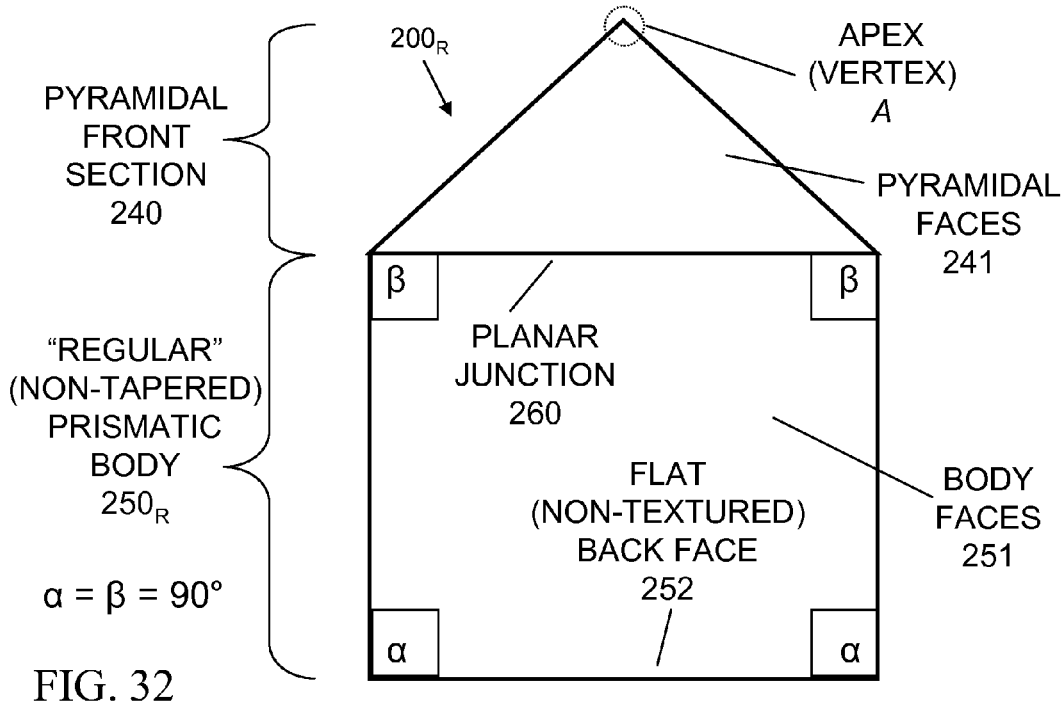
FIG. 32 is a side view of another second-mode geometric ceramic element in accordance with the present invention.
Figure 33:
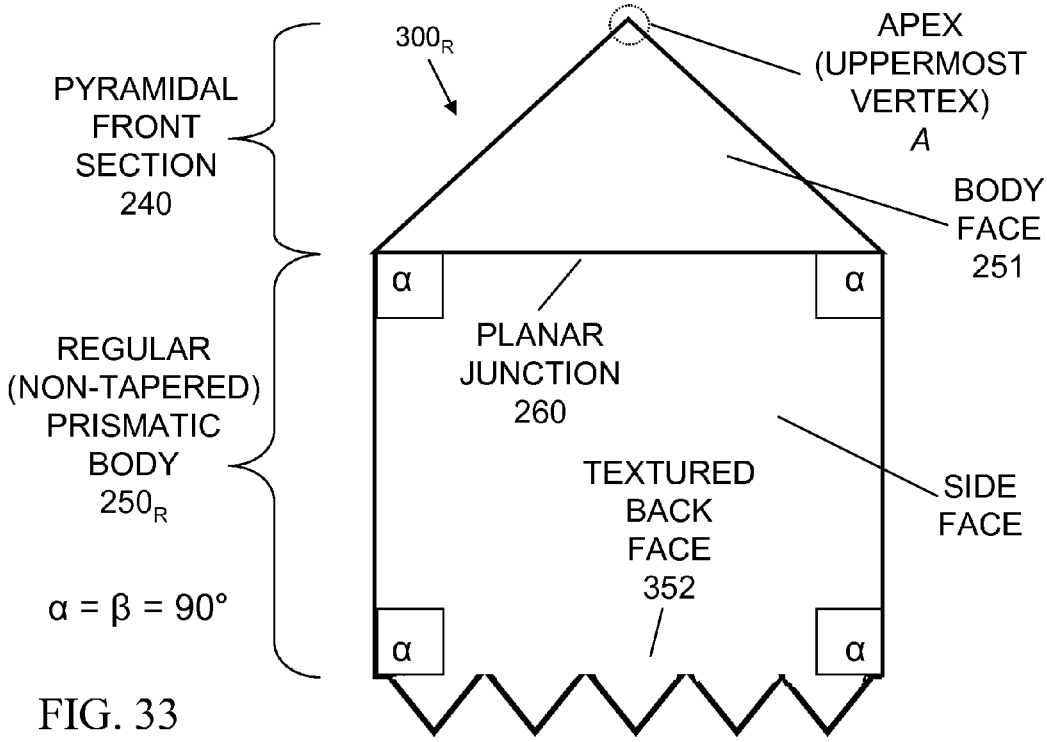
FIG. 33 is a side view of another hybrid-mode geometric ceramic element in accordance with the present invention.
Figure 34:
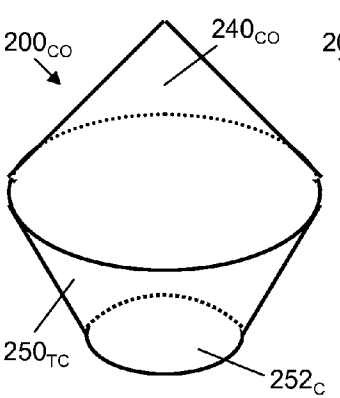
FIG. 34 through FIG. 41 are perspective views of various inventive second-mode embodiments having a conical (FIG. 34, FIG. 36, FIG. 38, FIG. 40) or spherical (FIG. 35, FIG. 37, FIG. 39, FIG. 41) front face, a tapered (FIG. 34, FIG. 35, FIG. 36, FIG. 37) or non-tapered prismatic body (FIG. 38, FIG. 39, FIG. 40, FIG. 41), and a smooth (FIG. 34, FIG. 35, FIG. 38, FIG. 39) or textured (FIG. 36, FIG. 37, FIG. 40, FIG. 41) back face.
Figure 35:
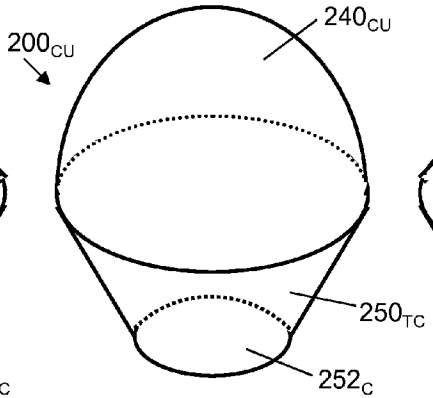
Figure 36:
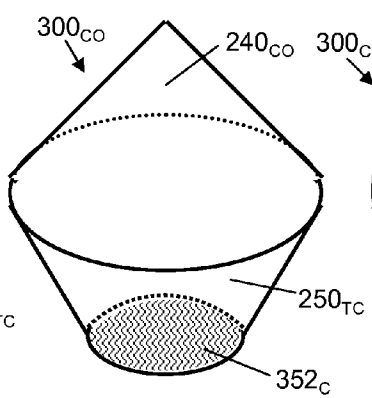
Figure 37:
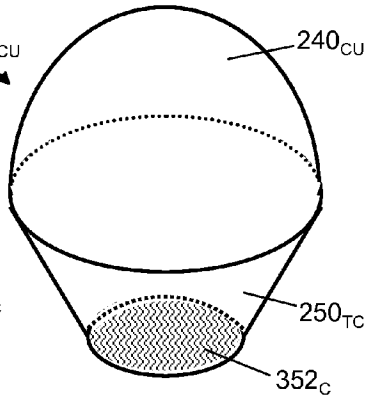
Figure 38:
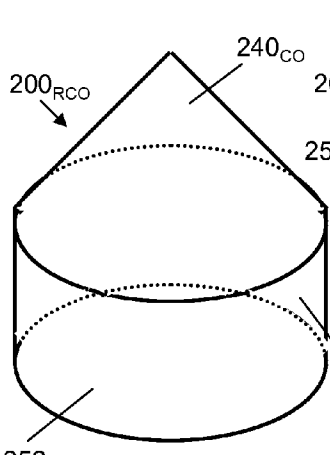
Figure 39:
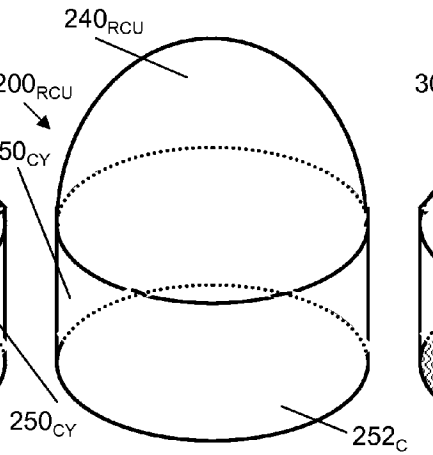
Figure 40:
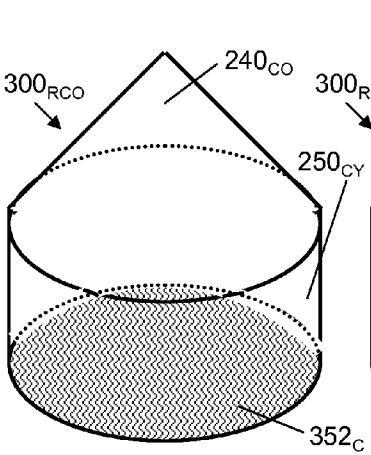
Figure 41:
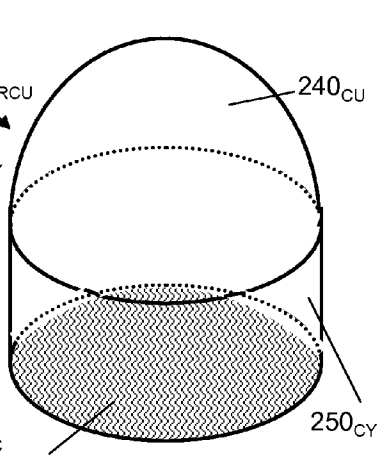

Reference is now made to FIG. 18 through FIG. 33, which are illustrative by way of example of inventive second-mode practice (FIG. 18 through FIG. 30, and FIG. 32) and inventive hybrid-mode practice (FIG. 31 and FIG. 33). A principle shared by first-mode, second-mode, and hybrid-mode inventive practice is that the inventive geometric shape of a ceramic element can affect the propagation and interaction of the shock waves that enter the ceramic element at the front face and are reflected off of the back face (or, equivalently expressed, off of the interface between the back face and the adjacent elastomeric matrix material).

Inventive first-mode ceramic elements 100 are frequently practiced so that the inventive ceramic elements 100 are large enough that the inventive texturing of back face 120 imparts significant benefit in terms of determining shock wave propagation and interaction concomitant projectile impact. In contrast, inventive second-mode ceramic elements 200 are frequently practiced so that the inventive ceramic elements 200 are relatively small and are closely arranged so as to be tantamount to larger ceramic elements having qualities akin to those of inventive first-mode ceramic elements 100.

The shock wave attenuating attributes of an inventive second-mode ceramic element 200 array tend to be furthered when the inventive second-mode ceramic elements 200 are more tightly "packed" together, e.g., closely or contiguously arranged. The terms "areal density" and "areal packing density," as used synonymously herein, denote mass per unit area, such as measured in the geometric plane of the front surface of an inventive composite armor system. The areal packing density of the inventive second-mode ceramic elements 200 should preferably be as complete as possible, minimizing small gaps between the inventive second-mode ceramic elements 200.

As shown in FIG. 18 through FIG. 29, inventive second-mode ceramic element 200 has two geometric polyhedral components, viz., a pyramidal front section 240 and a tapered prismatic body section 250. Pyramidal front 240, which is the "strike" section, consists of at least three triangular pyramidal faces 241. Tapered prismatic body 250 consists of a polygonal back face 252 (having at least three sides) and at least three quadrilateral body faces 251. Hence, inventive second-mode ceramic element has at least seven faces, namely, at least three pyramidal faces 241, at least three body faces 251, and a polygonal back face 252. Pyramidal faces 241 share a common vertex, apex A. Pyramidal front section 240 and tapered prismatic body section 250 share a polygonal (planar) junction 260.

The body section of an inventive second-mode or inventive hybrid-mode ceramic element has the geometric shape of a prismatoid having two parallel polygonal bases. Frequent inventive practice provides for second-mode or hybrid-mode ceramic elements having the geometric shape of a tapered prism (synonymously referred to herein as a truncated pyramid or a pyramidal frustum). Inventive practice sometimes provides for second-mode or hybrid-mode ceramic elements having the geometric shape of a prism, which is not tapered. A prism is a polyhedron having two congruent, parallel, opposite, polygonal bases and at least three parallelogram lateral faces. The lateral faces are formed by parallel straight lines connecting corresponding vertices of the bases. A tapered prism is a polyhedron having two similar, non-congruent, parallel, opposite, polygonal bases and at least three trapezoidal lateral faces. The lateral faces are formed by non-parallel straight lines connecting corresponding vertices of the bases. Otherwise expressed, a tapered prism is a prism that is gradually narrower or thinner toward one of the two bases.

Figure 18:
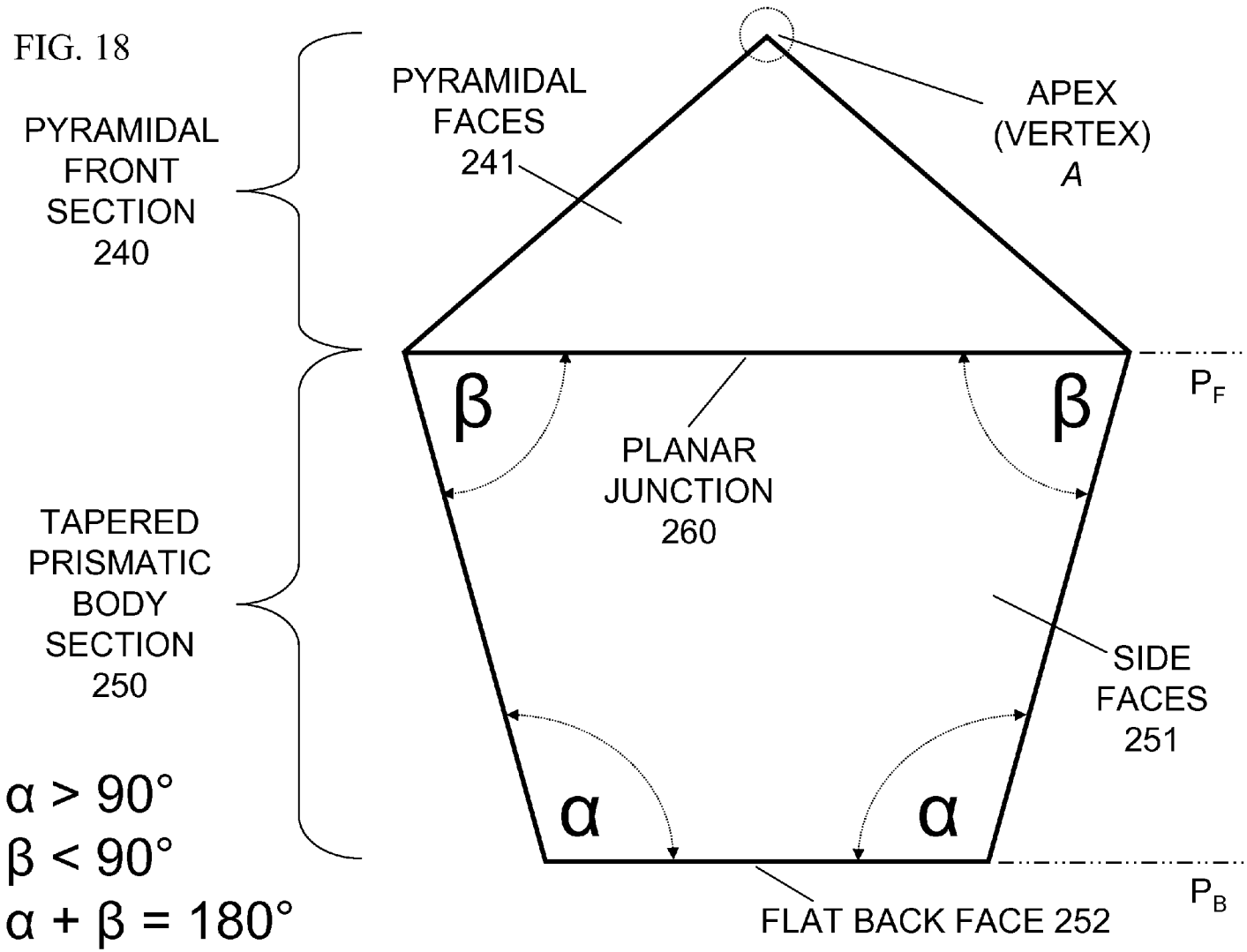
FIG. 18 is a side view of a second-mode geometric ceramic element in accordance with the present invention.

The inventive second-mode ceramic element 200 depicted in side view in FIG. 18 can be considered to be representative of either a triangular (three-sided) variety tapered-body element 200 (having seven total faces consisting of a triangular back face 252, three body faces 251, and three pyramidal faces 241) or a quadrilateral (four-sided) variety tapered-body element 200 (having nine total faces consisting of a quadrilateral back face 252, four body faces 251, and four pyramidal faces 241). Pyramidal front 240 and tapered prismatic body 250 adjoin at a polygonal junction 260, which lies in a geometric plane $p_f$ that is parallel to the geometric plane $p_b$ in which lies the polygonal back face 252.

Inventive ceramic element 200 is frequently embodied so as to be characterized by geometrical symmetry, for instance axial symmetry (with respect to a geometric axis a) or bilateral symmetry (with respect to a geometric plane passing through geometric axis a). A symmetrically configured inventive tapered-body ceramic element 200 is a regular polyhedral shape, characterized by axial or bilateral symmetry with respect to a geometric axis or plane passing through apex A. Nevertheless, symmetrical geometry is not necessary to inventive practice of ceramic element 200. For instance, the pyramidal front 240 can have unequal pyramidal faces 241 irregularly arranged so that apex A is "off-center," e.g., skewed with respect to an imaginary central axis that extends through the tapered prismatic body section 250.

As shown in FIG. 18, each body face 251 is disposed at the same angle $\alpha$ with respect to back geometric plane $p_b$, and at the same angle $\beta$ with respect to front geometric plane $p_f$. Angle $\alpha$ is greater than ninety degrees. Angle $\beta$ is less than ninety degrees. The sum of angle $\alpha$ plus angle $\beta$ is one hundred eighty degrees. According to usual inventive practice of tapered-body ceramic element 200, it is characterized by: an angle $\alpha$ that is in the range greater than ninety degrees and less than or equal to about one hundred fifty degrees; an angle $\beta$ that is in the range greater than or equal to about thirty degrees and less than ninety degrees.

Multifarious shapes of inventive tapered-body ceramic element 200 are possible in inventive practice, of which FIG. 19 through FIG. 29 illustrate but of few. FIG. 19, FIG. 25, FIG. 26, and FIG. 27 each show an inventive tapered-body ceramic element 200 of the three-sided variety. FIG. 20, FIG. 21, FIG. 28, and FIG. 29 each show an inventive tapered-body ceramic element 200 of the four-sided variety. FIG. 23 shows an inventive tapered-body ceramic element 200 of the six-sided variety. FIG. 24 shows an inventive tapered-body ceramic element 200 of the eight-sided variety. Note that inventive practice of a tapered-body ceramic element admits of wide variability in sizes, shapes, configurations, and dimensions (e.g., lengths, widths, and heights) of pyramidal front section 240 and of tapered prismatic body section 250.

Varieties and shapes differ among the inventive tapered-body ceramic elements 200 depicted in FIG. 19 through FIG. 29, but each of these examples is characterized by regularity in the respects that geometric plane $p_f$ (in which lies the polygonal junction 260) is parallel to geometric plane $p_b$ (in which lies the polygonal back face 252), inventive tapered-body ceramic element 200 is symmetrical about a geometric axis a, and polygonal junction 260 is geometrically similar to but larger than polygonal back face 252. Although typical inventive practice provides for a regular character of an inventive tapered-body ceramic element, inventive practice is possible whereby an inventive tapered-body ceramic element has an irregular character in one or more ways contrary to the above-noted aspects.

The inventive hybrid-mode ceramic element 300 depicted in side view in FIG. 31 can be considered to be representative of either a triangular (three-sided) variety tapered-body element 300 (having seven total faces consisting of a triangular textured back face 352, three body faces 251, and three pyramidal faces 241) or a quadrilateral (four-sided) variety tapered-body element 300 (having nine total faces consisting of a quadrilateral textured back face 352, four body faces 251, and four pyramidal faces 241). Hybrid-mode inventive practice combines features of first-mode and second-mode inventive practice. Inventive hybrid-mode ceramic element 300 shown in FIG. 31 has essentially the same overall geometric shape as has inventive second-mode ceramic element 200 shown in FIG. 18, the only difference being that inventive hybrid-mode ceramic element 300 has a textured back face 352, whereas inventive second-mode ceramic element 200 has a non-textured (flat) back face 252.

The textured back face 352 of inventive hybrid-mode ceramic element 300 is, practically speaking, the same textured surface as the textured back face 120 of inventive first-mode ceramic element 100, which is exemplified in FIG. 1 through FIG. 17; that is, back face 352 and back face 120 lend themselves to the same wide range of possibilities of textural configurations. The various back face 120 textures shown in FIG. 1 through FIG. 17 are also illustrative, by way of example, of back face 352 textures. Like back face 120 (which can be a one-dimensionally textured back face $\mathbf{120}_1$ and/or a two-dimensionally textured back face $\mathbf{120}_2$), back face 352 can be either one-dimensionally textured, or two-dimensionally textured, or both one-dimensionally and two-dimensionally textured.

Inventive second-mode ceramic element 200 shown in FIG. 32 and inventive hybrid-mode ceramic element 300 shown in FIG. 33 share the characteristic of rectangularity. As shown in FIG. 18 and FIG. 31, respectively, inventive tapered-body second-mode ceramic element 200 and inventive tapered-body hybrid-mode ceramic element 300 are each characterized by an obtuse angle α and an acute angle β. In contrast, as shown in FIG. 32 and FIG. 33, respectively, inventive straight-body second-mode ceramic element $\mathbf{200}_R$ and inventive straight-body hybrid-mode ceramic element $\mathbf{300}_R$ are each characterized by a right angle α and a right angle β. Otherwise expressed, according to inventive straight-body practice, α=β=90°; polygonal junction 260 is equal to the perimeter of back face 252. According to inventive tapered-body practice, α>90° and β<90°; polygonal junction 260 is larger than the perimeter of back face 252.

As distinguished from inventive tapered-body practice, inventive invertedly-tapered-body practice provides for angle β greater than ninety degrees and angle α less than ninety degrees. Inventive invertedly-tapered-body second-mode or third-mode practice is exemplified by FIG. 30. The inventive invertedly-tapered second-mode ceramic element $\mathbf{200}_1$ shown in FIG. 30 is characterized by an acute angle α and an obtuse angle β, i.e., α<90° and β>90°; polygonal junction 260 is smaller than the perimeter of back face 252. The inventive ceramic element is shown in FIG. 30 to be an inventive invertedly-tapered second-mode ceramic element having a flat back face, and is readily envisioned to be an inventive invertedly-tapered hybrid-mode ceramic element having a textured back face.

As distinguished from a tapered prismatic body 250, a "straight" (non-tapered) prismatic body $\mathbf{250}_R$ is purely prismatic. The tapered prismatic body 250 of typical inventive tapered-body practice consists of a polygonal back face 252 or 352 and at least three trapezoidal body faces 251. The straight (non-tapered) prismatic body $\mathbf{250}_R$ of typical inventive straight-body practice consists of a polygonal back face 252 or 352 and at least three rectangular body faces $\mathbf{251}_R$. Frequent inventive practice provides for a geometric axis of symmetry (e.g., rotational or lateral symmetry), such as axis a shown in FIG. 18, for inventive second-mode ceramic elements 200 and $\mathbf{200}_R$, as well as for inventive third-mode ceramic elements 300 and $\mathbf{300}_R$.

Inventive second-mode elements 200 and $\mathbf{200}_R$ and inventive hybrid-mode elements 300 and $\mathbf{300}_R$ each have a rectilinear character. In contrast, with reference to FIG. 34 through FIG. 41, inventive second-mode elements $\mathbf{200}_{CO}$, $\mathbf{200}_{RCO}$, $\mathbf{200}_{CU}$, and $\mathbf{200}_{RCU}$, and inventive hybrid-mode elements $\mathbf{300}_{CO}$, $\mathbf{300}_{RCO}$, $\mathbf{300}_{CU}$, and $\mathbf{300}_{RCU}$, each have a curved or curvilinear character. Second-mode inventive ceramic elements $\mathbf{200}_{CO}$ (FIG. 34), $\mathbf{200}_{RCO}$ (FIG. 38), $\mathbf{300}_{CO}$ (FIG. 36), and $\mathbf{300}_{RCO}$ (FIG. 40) each have a conical front section $\mathbf{240}_{CO}$. Inventive ceramic elements $\mathbf{200}_{CU}$ (FIG. 35), $\mathbf{200}_{RCU}$ (FIG. 39), 300*CU* (FIG. 37), and $\mathbf{300}_{RCU}$ (FIG. 41) each have a spherical or spheroidal front section $\mathbf{240}_{CO}$. FIG. 34 through FIG. 37 each show a truncated conical body section $\mathbf{250}_{TC}$. FIG. 38 through FIG. 41 each show a cylindrical body section $\mathbf{250}_{CY}$. Flat (untextured) back face $\mathbf{252}_C$ (FIG. 34, FIG. 35, FIG. 38, FIG. 39) and textured back face $\mathbf{352}_C$ (FIG. 36, FIG. 37, FIG. 40, FIG. 41) are each round, such as circular or oval (e.g., elliptical, ellipsoidal, or irregularly oval). Like their rectilinear counterparts, in accordance with the present invention, curved/curvilinear ceramic elements are frequently practiced so as to exhibit axial symmetry.

With reference to FIG. 42 through FIG. 45, inventive ceramic elements of first mode and/or second mode and/or hybrid mode, in any combination, are suitable for inclusion in a composite armor system that includes a frontal layer of elastic (e.g., viscoelastic) matrix material and a backing layer of rigid (stiff) material. More specifically, according to typical inventive practice, inventive ceramic elements are embedded in at least one elastic matrix material layer of an inventive composite plural-layer material armor system 1000. The inventive ceramic elements are arranged along a geometric plane corresponding to the front (initial strike) surface of the frontal layer. The arrayal of the inventive ceramic elements can vary; in particular, depending on the inventive embodiment, the inventive ceramic elements can be arranged in one or more rows, and in one or more columns, along the defining geometric plane. The inventive ceramic elements are coupled to the backing layer (e.g., adhered to the backing layer via the elastic (e.g., elastomeric) matrix material and/or a different, bonding material) so that the corresponding back faces are adjacent to the backing layer. FIG. 42 through FIG. 45 are diagrammatic in nature and are not intended to suggest limitation or preference in terms of thicknesses of layers or numbers of ceramic elements or positions of ceramic elements or distances between ceramic elements.

According to typical inventive practice, elastic matrix material 1222 is an elastomeric material, such as a thermoset elastomer. The terms "elastomer" and "elastomeric," as used herein, broadly refer to any material that is both polymeric and elastic, and are considered to include both natural (e.g., natural rubber) and synthetic (e.g., thermoset or thermoplastic) materials. Polyurethane and polyurea are two thermoset elastomers that will frequently be suitable for constituting the elastomeric matrix material 1222 in inventive practice, as polyurethane and polyurea are each characterized by high elongation-to-failure (strain-to-failure).

Figure 42:
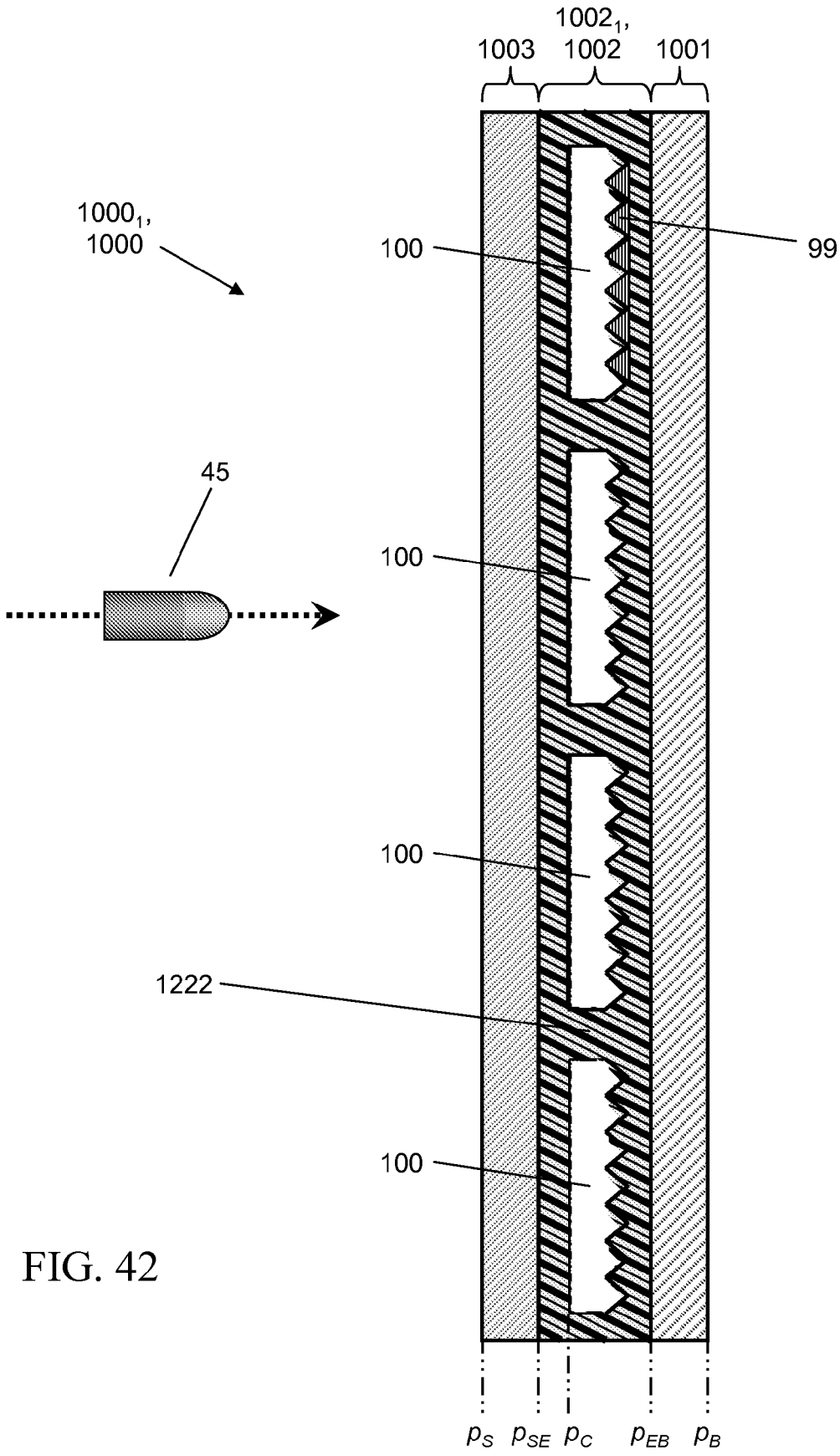
FIG. 42 is a side cross-sectional view of a three-layer material armor system in accordance with the present invention, wherein inventive first-mode geometric ceramic elements are contained in the intermediate layer.

Illustrated in FIG. 42 is an inventive three-layer material armor system $\mathbf{1000}_1$ including a rigid backing layer 1001, a ceramic-embedded elastic matrix material layer $\mathbf{1002}_1$, and a debris-containment layer (also referred to herein as a "spall-containment" layer or a "spall cover") 1003. Backing layer 1001 and spall-containment layer 1003 are each composed of a rigid material—such as a fiber-reinforced polymer matrix material, or a metallic (metal or metal alloy) material (e.g., steel, titanium, aluminum)—that is appropriate to the contemplated armor application(s). Ceramic-embedded elastic matrix material layer $\mathbf{1002}_1$ is composed of an elastic (e.g., elastomeric) matrix material 1222 and plural inventive first-mode ceramic elements 100, which are embedded in the elastic (e.g., elastomeric) matrix material 1222.

Generally in inventive practice, the two essential layers of a inventive plural-layer armor system 1000 are the ceramic-embedded elastic matrix material layer 1002 and the backing layer 1001; in addition thereto, an inventive armor system 1000 can be embodied to include one or practically any plural number of additional layers or sub-layers of practically any material and configurational description, for instance metallic, fiber-reinforced polymer, or ceramic-embedded polymer. The inventive two-layer material armor system $\mathbf{1000}_1$' shown in FIG. 44 includes a rigid backing layer 1001 and a ceramic-embedded elastic matrix material layer $\mathbf{1002}_1$, but does not include a spall-containment layer 1003. Spall-containment layer 1003, which serves a purpose of containing flying debris (spall) that results from impact of a projectile upon the inventive material system 1000, is includable or excludable in the inventive material system 1000, depending on the contemplated application(s). The inventive three-layer material armor system $\mathbf{1000}_2$ depicted in FIG. 43 includes a rigid backing layer 1001, a ceramic-embedded elastic matrix material layer $\mathbf{1002}_2$, and a spall-containment layer 1003. The inventive two-layer material armor system $\mathbf{1000}_2$' shown in FIG. 45 includes a backing layer 1001 and a ceramic-embedded elastic matrix material layer $\mathbf{1002}_2$, but does not include a spall-containment layer 1003. Regardless of whether or not an inventive plural-layer material armor system 1000 includes a spall-containment layer 1003, the ceramic-embedded elastic matrix material 1002 may be appropriately described as the "front" layer of inventive plural-layer material armor system 1000, as the spall-containment layer 1003 (if included therein) serves a limited function and, essentially, the projectile initial strikes the ceramic-embedded elastic matrix material 1002.

Figure 43:
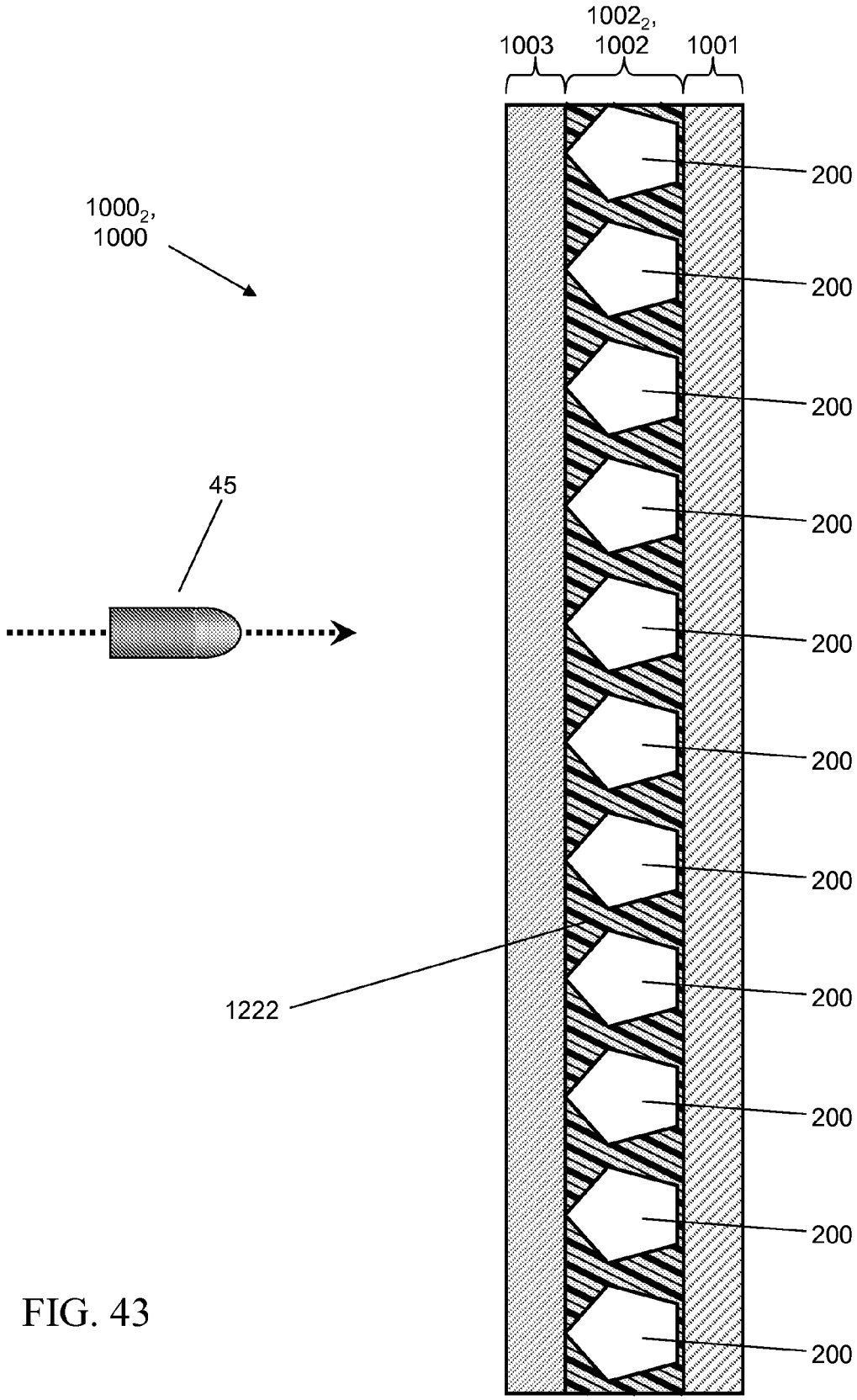
FIG. 43 is a side cross-sectional view of a three-layer material armor system in accordance with the present invention, wherein inventive second-mode geometric ceramic elements are contained in the intermediate layer.
Figure 44:
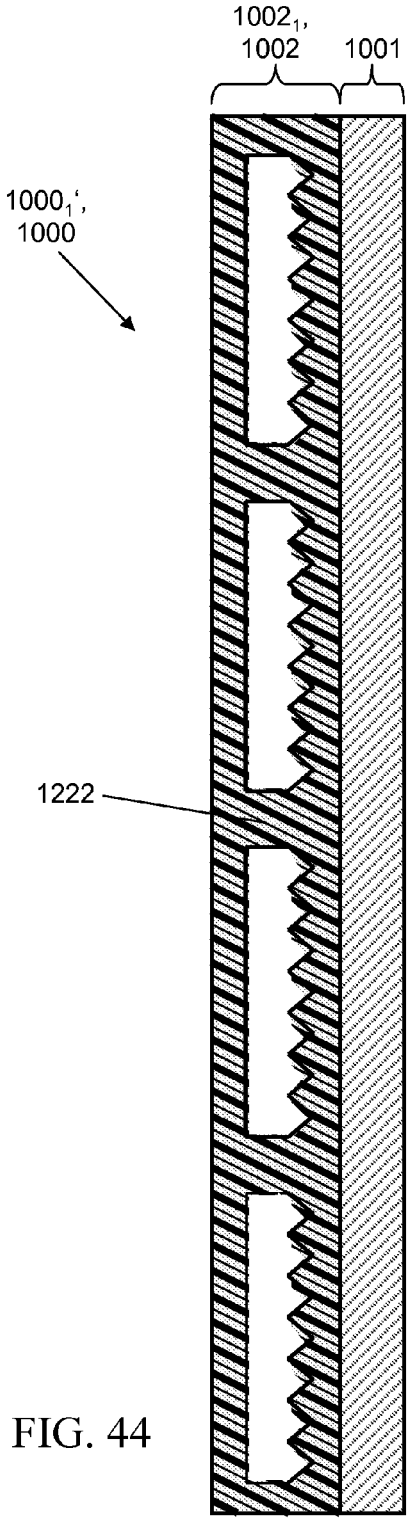
FIG. 44 is a side cross-sectional view of a two-layer material armor system in accordance with the present invention, wherein inventive first-mode geometric ceramic elements are contained in the front layer.
Figure 45:
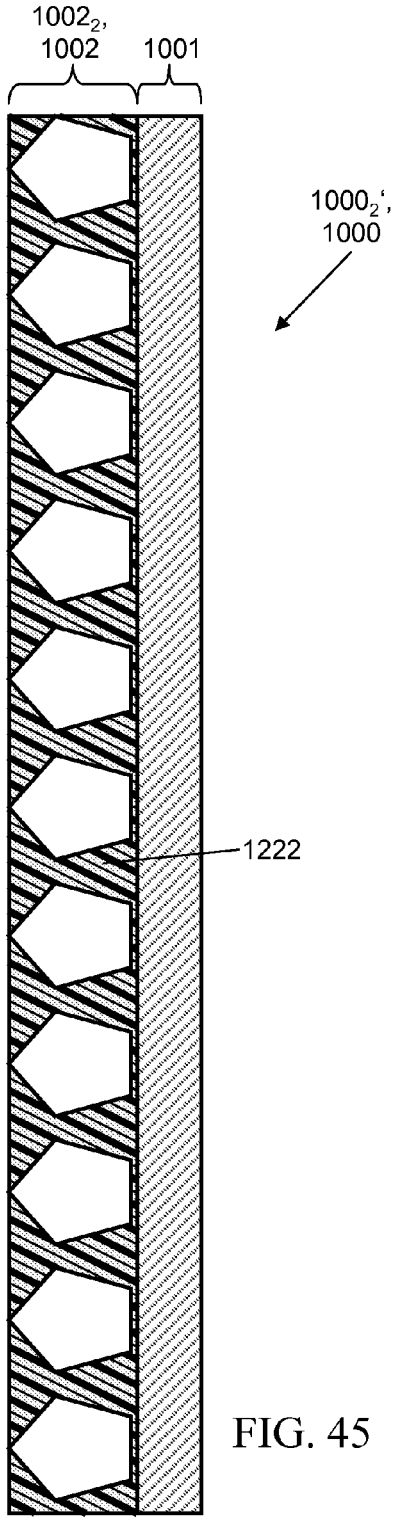
FIG. 45 is a side cross-sectional view of a two-layer material armor system in accordance with the present invention, wherein inventive second-mode geometric ceramic elements are contained in the front layer.

As shown in FIG. 42 and FIG. 44, the inventive first-mode ceramic elements are arrayed so that: the corresponding flat front faces are at least approximately situated in the same, first geometric plane; the corresponding textured back faces are generally or essentially situated in the same, second geometric plane; the first geometric plane and the second geometric plane are at least approximately parallel to each other. As shown in FIG. 43 and FIG. 45, the inventive second-mode ceramic elements are arrayed so that: the corresponding apexes are at least approximately situated in the same, first geometric plane; the corresponding flat back faces are at least approximately situated in the same, second geometric plane; the corresponding polygonal junctions are at least approximately situated in the same, third geometric plane; the first geometric plane, the second geometric plane, and the third geometric plane are at least approximately parallel to each other. If the inventive ceramic elements depicted in FIG. 43 and FIG. 45 are conceived to be inventive hybrid-mode ceramic elements, the corresponding textured back faces are generally or essentially situated in the same, second geometric plane.

Accordingly, as shown in FIG. 42 through FIG. 45, the inventive ceramic elements are arrayed in a single geometric plane. For instance, as shown in FIG. 42, ceramic elements 100 of inventive armor system 1000 are arranged along a geometric plane $p_C$, which corresponds to the front (initial strike) surface of spall-containment layer 1003. More specifically, geometric plane $p_C$ (described by the respective front faces of the ceramic elements 100), geometric plane $p_S$ (described by the front surface of spall-containment layer 1003), geometric plane $p_{SF}$ (described by the back surface of spall-containment layer 1003, and by the front surface of ceramic-embedded elastomeric matrix material layer $\mathbf{1002}_1$), geometric plane $P_{EB}$ (described by the back surface of ceramic-embedded elastomeric matrix material layer $\mathbf{1002}_1$, and by the front surface of backing layer 1001), and geometric plane $p_B$ (described by the back surface of backing layer 1001), are parallel to each other.

The sole difference between the inventive three-layer material armor system $\mathbf{1000}_1$ shown in FIG. 42 and the inventive three-layer material armor system $\mathbf{1000}_2$ shown in FIG. 43 resides in the inventive ceramic elements that are embedded in the elastic matrix material 1222 of the ceramic-embedded elastic matrix material layer 1002. Similarly, the sole difference between the inventive two-layer material armor system $\mathbf{1000}_1$' shown in FIG. 44 and the inventive two-layer material armor system $\mathbf{1000}_2$' shown in FIG. 45 resides in the inventive ceramic elements that are embedded in the elastic matrix material 1222 of the ceramic-embedded elastic matrix material layer 1002. As shown in FIG. 42 and FIG. 44, plural inventive first-mode ceramic elements 100 are embedded in the elastic matrix material 1222, thereby forming ceramic-embedded elastic matrix material layer $\mathbf{1002}_1$. As shown in FIG. 43 and FIG. 45, plural inventive second-mode ceramic elements 200 are embedded in the elastic matrix material 1222, thereby forming ceramic-embedded elastic matrix material layer $\mathbf{1002}_2$.

The inventive second-mode ceramic elements 200 shown in FIG. 43 and FIG. 45 are shown spaced somewhat apart for illustrative purposes. According to frequent inventive practice, the rectilinear geometric character of inventive second-mode ceramic elements 200—straight-sided and straight-edged—facilitates the tight "packing" of the inventive second-mode ceramic elements 200. This favorable disposition to close arrangement can be availed of regardless of whether inventive second-mode ceramic elements 200 are triangular, rectangular, pentagonal, hexagonal, etc., in nature. The flatness of the back face 252 fosters a favorable tendency toward maximization of load transfer to the backing 1001. Closely spaced arrayal of inventive second-mode ceramic elements 200 is concomitant with greater areal coverage, thus permitting the tailoring of armor performance to defeat threatened projectiles (e.g., large fragments, large ball rounds, smaller armor-piercing rounds) while minimizing weight. Angles $\alpha$ and $\beta$ of the inventive second-mode ceramic elements 200 can be selected in consideration of desired distances between the inventive second-mode ceramic elements 200, thus controlling the areal coverage of the array of the inventive second-mode ceramic elements 200, For instance, in view of the anticipated threats, the importance of adjusting the total areal density of the inventive second-mode ceramic elements 200 can be balanced against the importance of providing penetration resistance to small caliber armor-piercing rounds.

Upon subjection of an inventive composite material armor system 1000 to impact by a projectile (such as projectile 45 shown in FIG. 42 and FIG. 43), the various components of the inventive material armor system 1000 serve corresponding functions, as elaborated upon in the following three paragraphs.

As previously pointed out herein, the spall-containment layer serves to contain flying debris, e.g., fragments of the projectile and/or the ceramic material.

The inventive ceramic element that is contacted by the projectile serves to blunt and/or break up the projectile. Moreover, as noted hereinabove and as further described hereinbelow, the contacted inventive ceramic element effects a physical mechanism that attenuates the shock waves internal to the inventive ceramic element, thereby reducing the extent of its fracture and improving its capability of blunting and/or breaking up the projectile. Furthermore, if and to the extent that the contacted inventive ceramic element fractures, it absorbs energy. If more than one inventive ceramic element is contacted by the projectile, each inventive ceramic element may behave similarly.

The elastic (e.g., elastomeric) matrix material absorbs energy and constrains the fractured inventive ceramic element(s), thereby imparting some continued, partial effectiveness of the fractured ceramic element(s). In addition, the elastic matrix material diffuses the shock resulting from the impact, thereby preventing the inventive ceramic elements near the impact area from fracturing; in this manner, the elastic matrix material preserves the ballistic capability of neighboring ceramic material for future impacts, i.e., a "multi-hit" capability.

The backing serves as a "catcher" to stop debris such as the broken pieces of the projectile and/or the ceramic material.

The elastic matrix material affords benefits other than those associated with projectile impact such as noted hereinabove. The elastic matrix material can serve as an adhesive for assembly of an inventive composite armor system 1000 and, due to its placement at the front thereof, can serve to protect the inventive ceramic elements from accidental damage during service (e.g., maintenance or repair).

The coupling of the inventive ceramic elements to the backing layer is generally an important aspect of inventive practice. In inventive first-mode ceramic element practice, the textured back face 120 of an inventive first-mode ceramic element 100 may not adhere to backing 1001 as well as desired if a conventional, unadulterated polymeric material (e.g., polyurethane or polyurea or some combination thereof) is used as the elastomeric matrix material 1222 of the ceramic-embedded elastomeric matrix layer 1002.

Instead of a conventional, unadulterated polymeric material, it may be advantageous to employ, as the elastomeric matrix material 1222, a filled polymeric material that incorporates metal filler particles and/or ceramic filler particles. Such a particle-filled elastomeric matrix material would represent a bonding material with higher stiffness (acoustic impedance) than would be necessary with flat back faces, such as those characterizing conventional ceramic elements, and such as those characterizing inventive second-mode ceramic elements 200.

Additionally or alternatively, a "leveling" fill material, such as a metallic material (e.g., aluminum) 99 shown in FIG. 42 in the back face 120 texture of the topmost inventive first-mode ceramic element 100, can be implemented to fill in the depressed areas of a textured back surface 120, thereby creating, in practical effect, a surface evenness that is more conducive to adherence to a backing 1001. For instance, a metal can be cast into the textured back face 120 surface to accomplish such levelness. Such an effectively "flattened" textured surface would more readily bond with a backing with the use of more commonly used polymers.

Figure 46:
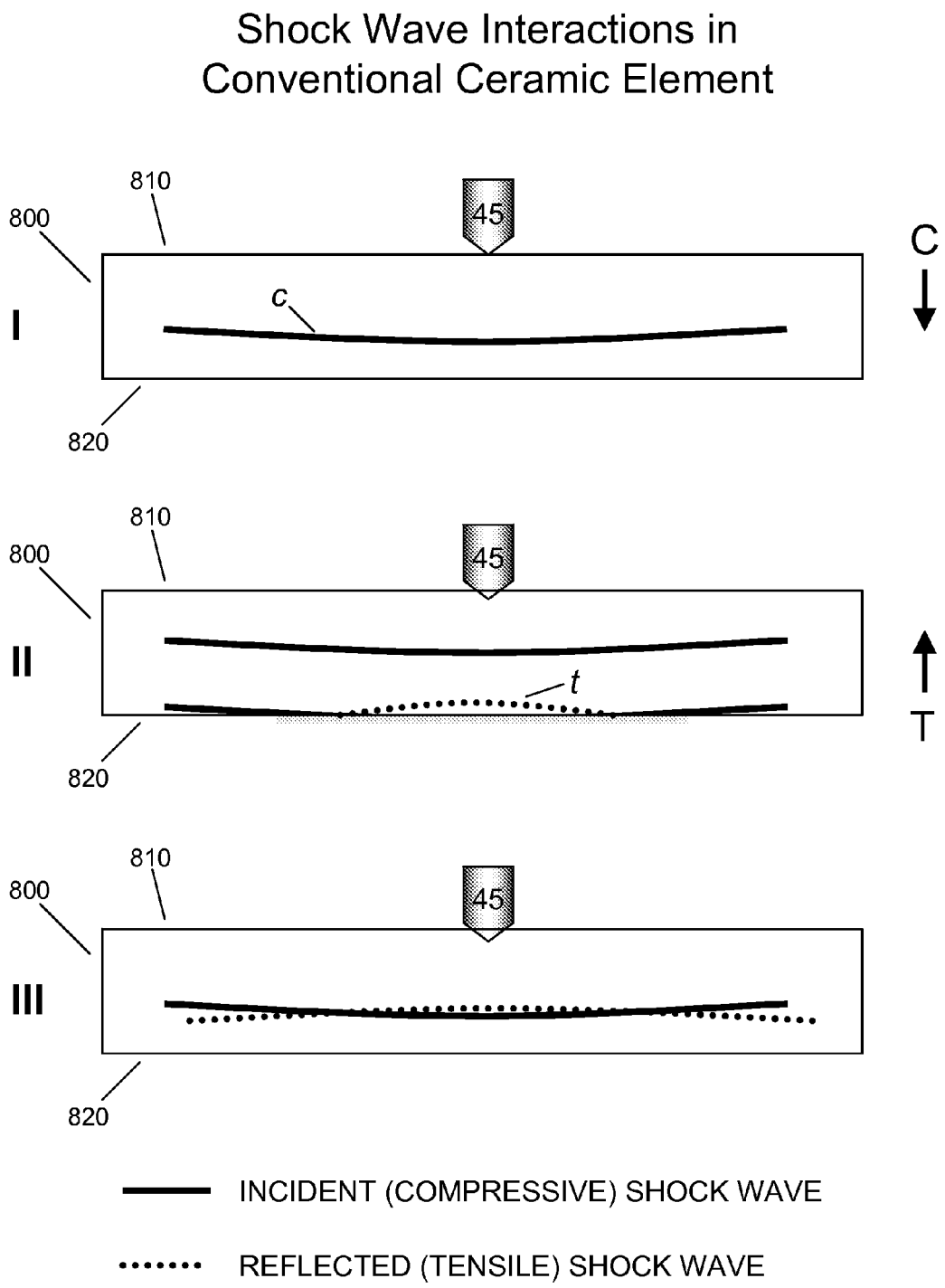
FIG. 46 is a diagram including successive side views of the same conventional ceramic element, and illustrating complex interaction between incident (compressive) shock waves and reflected (tensile) shock waves, such physical mechanism typifying a conventional ceramic element upon impact by a projectile. Incident shock waves are diagrammatically depicted in solid line, and are indicated to travel in a generally downward direction C; reflected shock waves are diagrammatically depicted in dotted line, and are indicated to travel in a generally upward direction T.

With reference to FIG. 46, in conventional ceramic elements 800 the propagation and interaction of the incident shock waves c and reflected shock waves t are destructive in terms of fracture of the conventional ceramic elements 800. As shown in FIG. 46, conventional ceramic element 800 (which has flat and parallel front and back faces 810 and 820, respectively) is impacted by a projectile 45. Let us assume that rear face 820 forms an interface with a matrix material in which conventional ceramic element 800 is embedded. A near-planar incident (compressive stress) shock wave results from the contact of the projectile 45 with the conventional ceramic element 800 (phase "I") at its front face 810. As the projectile 45 penetrates the conventional ceramic element 800, more near-planar incident shock waves are generated, and near-planar reflected (tensile stress) shock waves are reflected from the rear face 820 of the conventional ceramic element 800 (phase "II"). The complex interaction of the near-planar incident shock waves and the near-planar reflected shock waves causes internal failure of conventional ceramic element 800; in particular, due to the near-planar nature of both the incident shock waves and the reflected shock waves, the complex interactions are characterized by high energy densities, and material failure results (phase "III").

Figure 47:
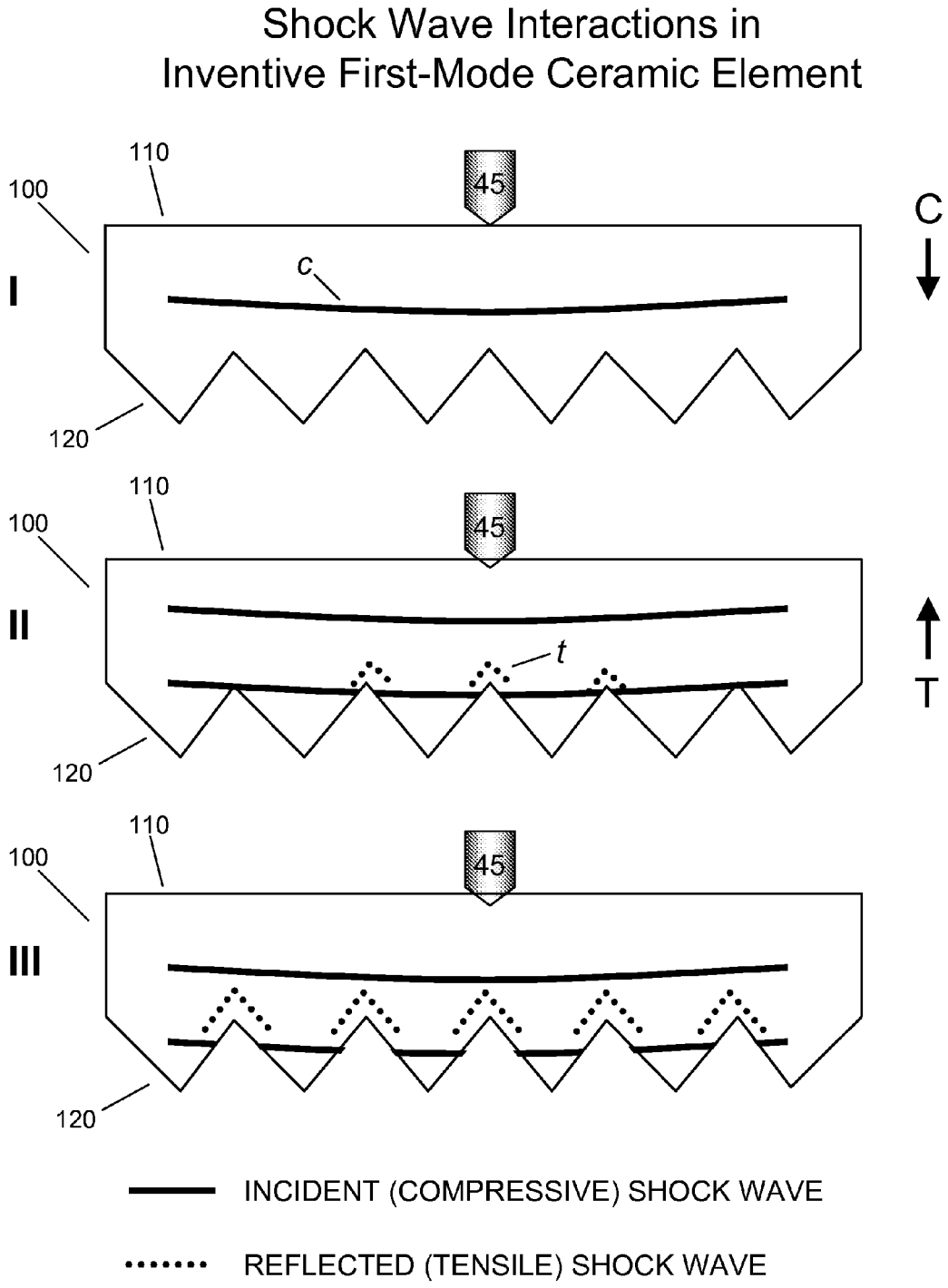
FIG. 47 is a diagram including successive side views of the same inventive first-mode ceramic element, and illustrating complex interaction between incident (compressive) shock waves and reflected (tensile) shock waves, such physical mechanism typifying an inventive first-mode ceramic element upon impact by a projectile. Incident shock waves are diagrammatically depicted in solid line, and are indicated to travel in a generally downward direction C; reflected shock waves are diagrammatically depicted in dotted line, and are indicated to travel in a generally upward direction T.
Figure 48:
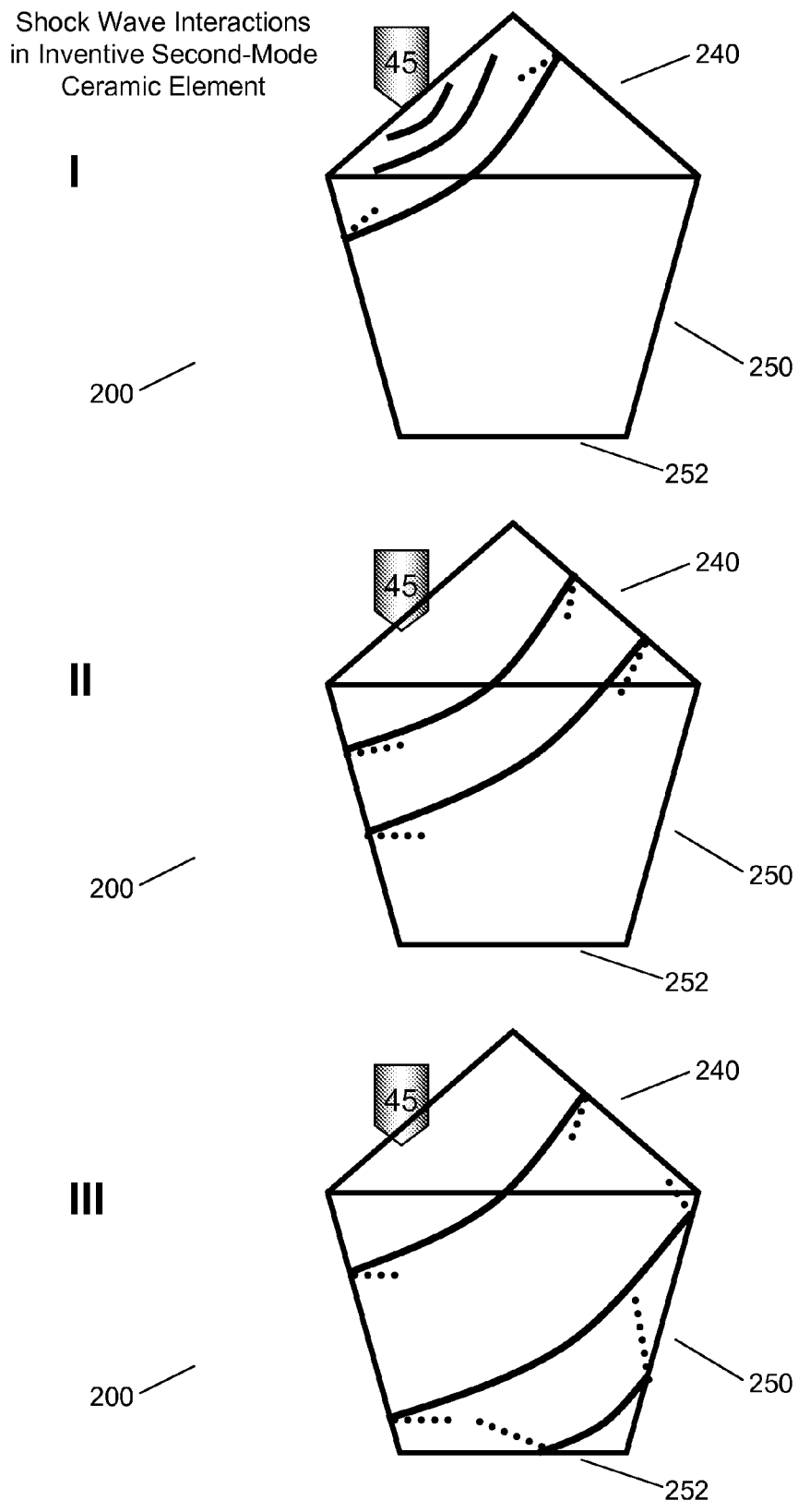
FIG. 48 is a diagram including successive side views of the same inventive second-mode ceramic element, and illustrating complex interaction between incident (compressive) shock waves and reflected (tensile) shock waves, such physical mechanism typifying an inventive second-mode ceramic element upon impact by a projectile. Incident shock waves are diagrammatically depicted in solid line, and are indicated to travel in a generally downward direction C; reflected shock waves are diagrammatically depicted in dotted line, and are indicated to travel in a generally upward direction T.
Figure 49:
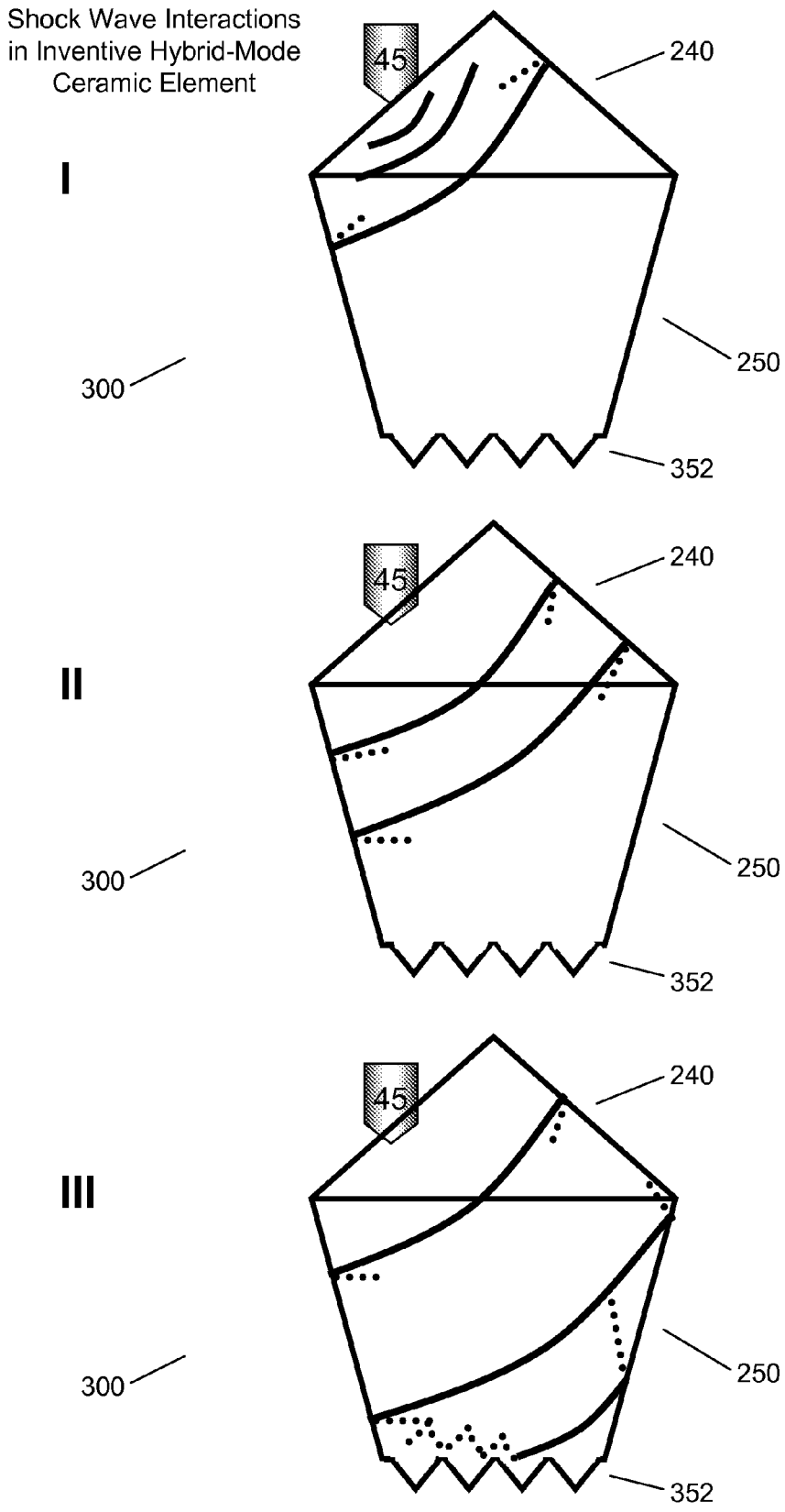
FIG. 49 is a diagram including successive side views of the same inventive hybrid-mode ceramic element, and illustrating complex interaction between incident (compressive) shock waves and reflected (tensile) shock waves, such physical mechanism typifying an inventive hybrid-mode ceramic element upon impact by a projectile. Incident shock waves are diagrammatically depicted in solid line, and are indicated to travel in a generally downward direction C; reflected shock waves are diagrammatically depicted in dotted line, and are indicated to travel in a generally upward direction T.

Reference is now made to FIG. 47 through FIG. 49, which each illustrate the propagation and interaction of the incident shock waves c and reflect shock waves t, occurring internal to an inventive ceramic element that is impacted by a projectile (e.g., bullet or fragment) 45. The propagation and interaction of the incident shock waves c and reflected shock waves t are considerably less destructive in inventive ceramic elements, with fracture being significantly reduced vis-à-vis conventional ceramic elements.

As shown in FIG. 47, inventive first-mode ceramic element 100 is impacted by a projectile 45. Let us assume that textured back face 120 forms an interface with a matrix material in which first-mode ceramic element 100 is embedded. A near-planar incident (compressive stress) shock wave results from the contact of the projectile 45 with the inventive first-mode ceramic element 100 at its front face 110 (phase "I"). As the projectile 45 penetrates the inventive first-mode ceramic element 100, more near-planar incident shock waves are generated, and non-planar reflected (tensile stress) shock waves are reflected from the rear face 120 of the inventive first-mode ceramic element 100 (phase "II"). The reflected shock waves are non-planar (for instance, characterized by a jagged profile as shown in FIG. 47) in correspondence with the non-planar character of textured back face 120. The complex interaction of the near-planar incident shock waves and the non-planar reflected shock waves is less likely to cause internal failure of inventive first-mode ceramic element 100. Rather, the textured back face 110 causes the reflected shock waves to be dispersed in both time and space; therefore, due to the near-planar nature of the incident shock waves but the non-planar nature of the reflected shock waves, the complex interactions are characterized by lower energy densities, and the material is less likely to fail (phase "III").

As shown in FIG. 48, inventive second-mode ceramic element 200 is impacted by a projectile 45. Let us assume that flat back face 252 forms an interface with a matrix material in which second-mode ceramic element 100 is embedded. The non-flat (pyramidal) front section 240 of inventive second-mode ceramic element 200 serves to induce yaw into the trajectory of projectile 45, thereby increasing the interaction of projectile 45 with the materials of the inventive armor system that contains inventive second-mode ceramic element 200 and increasing the probability of defeat of projectile 45. Further, the non-parallel surfaces of inventive second-mode ceramic element 200 reduce the devastating effects of reflected shock waves within the inventive second-mode ceramic element 200 after impact by projectile 45. Incident shock waves are initially skewed in accordance with the slanted geometry of the pyramidal front section 240. Then, the incident shock waves are reflected off of both the body faces 251 and the back face 252. The reflected shock waves are skewed in accordance with the slanted geometry of tapered prismatic body section 250. The complex interaction of the refractively skewed incident shock waves and the reflectively skewed reflected shock waves is less likely to cause internal failure of inventive first-mode ceramic element 100. The complex interactions are characterized by lower energy densities because of the divergent times and directions of the incident shock waves and the reflected shock waves; the material is less likely to fail.

As shown in FIG. 49, inventive hybrid-mode ceramic element 300 is impacted by a projectile 45. Let us assume that textured back face 352 forms an interface with a matrix material in which hybrid-mode ceramic element 100 is embedded. Similarly as illustrated in FIG. 48 for inventive second-mode ceramic element 200, the non-flat (pyramidal) front section 240 of inventive hybrid-mode ceramic element 300 serves to induce yaw into the trajectory of projectile 45, thereby increasing the interaction of projectile 45 with the materials of the inventive armor system that contains inventive hybrid-mode ceramic element 300 and increasing the probability of defeat of projectile 45. In a manner combining principles illustrated in FIG. 47 (for inventive first-mode ceramic element 200) and FIG. 48 (for inventive second-mode ceramic element 200), the non-parallel surfaces of inventive hybrid-mode ceramic element 300 reduce the devastating effects of reflected shock waves within the inventive hybrid-mode ceramic element 300 after impact by projectile 45. The reflected shock waves are not only skewed in accordance with the slanted geometry of tapered prismatic body section 250, but are also dispersed in accordance with the texture of back face 110. The complex interactions are characterized by lower energy densities because of the divergent times and directions of the refractively skewed incident shock waves and the reflectively skewed and reflectively dispersed reflected shock waves; the material is less likely to fail.

In accordance with typical inventive composite armor systems such as shown in FIG. 42 through FIG. 45, plural inventive ceramic elements are embedded in elastomeric matrix material 1222, thereby forming a ceramic-embedded elastomeric matrix material layer, which is situated on a backing layer 1001. The elastomeric matrix material 1222 depicted in FIG. 42 through FIG. 45 is entirely of the same composition. The present inventors have conceived, as an alternative to inventive armor systems having a homogenous ceramic-embedded polymeric matrix layer such as shown in FIG. 42 through FIG. 45, inventive armor systems having a heterogeneous ceramic-embedded polymeric matrix layer such as shown in FIG. 50 through FIG. 53.

With reference to FIG. 50 through FIG. 53, inventive armor system 9000 can be embodied so as to contain practically any manner of ceramic elements, inventive or conventional or both. FIG. 50 through FIG. 53 are diagrammatic in nature and are not intended to suggest limitation or preference in terms of thicknesses of layers or numbers of ceramic elements or positions of ceramic elements or distances between ceramic elements. Inventive plural-layer composite armor systems 9000 shown in FIG. 50 through FIG. 53 uniquely feature a ceramic-embedded heterogeneous polymeric matrix layer 9002, which is characterized by three distinct sections/regions/zones, referred to herein as "sub-layers." In addition, inventive plural-layer composite armor systems 9000 shown in FIG. 52 and FIG. 53 uniquely feature inventive ceramic elements 100 and inventive ceramic elements 200, respectively.

Ceramic-embedded heterogeneous polymeric matrix layer 9002 includes front-most sub-layer 9102, intermediate sub-layer 9202, and backmost sub-layer 9302. Like the inventive armor systems shown in FIG. 42 through FIG. 45, inventive armor systems 9000 include a rigid backing layer 1001. Optionally, inventive armor system 9000 can be embodied to further include, in front of and adjacent to front-most sub-layer 9102, a spall covering such as spall-containment layer 1003 shown in FIG. 42 and FIG. 43.

The sub-layers meet different performance requirements in furtherance of optimum performance of the armor system. Optimum performance is inventively obtained using polymeric materials exhibiting different properties in each of the three zones. The properties are engineered to manage the shock wave energy so as to reduce the damage in the vicinity of an impacted ceramic element, and so as to enhance the performance of the impacted ceramic element.

The front-most (strike-face) sub-layer, sub-layer 9102, consists of polymeric material 910. Polymeric material 910 serves to constrain the ceramic elements, contain spall, and limit lateral transmission of shock waves from ceramic elements to other, nearby ceramic elements. An example of a suitable polymeric material 910 for front-most sub-layer 9102 is a high elongation polyurea.

Behind front-most sub-layer 9102 is the intermediate sub-layer, sub-layer 9202, which is the ceramic-embedded polymeric matrix sub-layer. Intermediate sub-layer 9202 encompasses polymeric matrix material 920 and the ceramic elements, which are depicted as conventional ceramic elements 800 in FIG. 51, inventive first-mode ceramic elements 100 in FIG. 52, and inventive second-mode ceramic elements 200 in FIG. 53. The ceramic elements are embedded in polymeric matrix material 920, which therefore occupies the spaces between the ceramic elements. The ceramic elements can be arrayed, in one or more rows and one or more columns, along a geometric plane corresponding to the front (initial strike) surface of the front-most sub-layer 9102. Polymeric matrix material 920 serves to constrain the ceramic elements and to moderate the transmission of shock waves from ceramic elements to and into the neighboring ceramic elements. An example of a suitable polymeric material 920 for intermediate sub-layer 9202 is an elastomer filled with hollow microspheres such as microballoons 929 shown in FIG. 50. Suitable material compositions of the hollow microspheres include glass, carbon, and/or acrylic. The hollow microspheres will crush under shock conditions, thereby limiting transmission of the shock waves.

In intermediate sub-layer 9202, the interaction of the shock waves with the ceramic-polymer interfaces should be controlled precisely in order to balance transmission of shock waves into neighboring ceramic elements essentially in the following manner. On the one hand, the transmission of shock waves from impacted ceramic elements to proximate ceramic elements should be at energy levels sufficiently low to prevent damage to the proximate ceramic elements. On the other hand, the shock wave energy emanating from impacted ceramic elements should be as high as possible in order to disperse this impact energy over as large an area as possible.

Behind intermediate sub-layer 9202 is the backmost sub-layer, sub-layer 9302. Backmost sub-layer 9302 consists of polymeric material 930 and represents the region between the ceramic elements and the backing 1001. It is preferable that the acoustic impedance of polymeric material 930 be lower than that of the ceramic material and higher than that of the backing material, with a view toward permitting as much shock wave energy as possible to leave the ceramic elements without reflecting off of their back faces and causing destruction of the ceramic elements. An example of a suitable polymeric material 930 for backmost sub-layer 9302 is a higher modulus elastomer filled with solid particles (e.g., metal filler particles and/or ceramic filler particles) 939 such as shown in FIG. 50.

Figure 50:
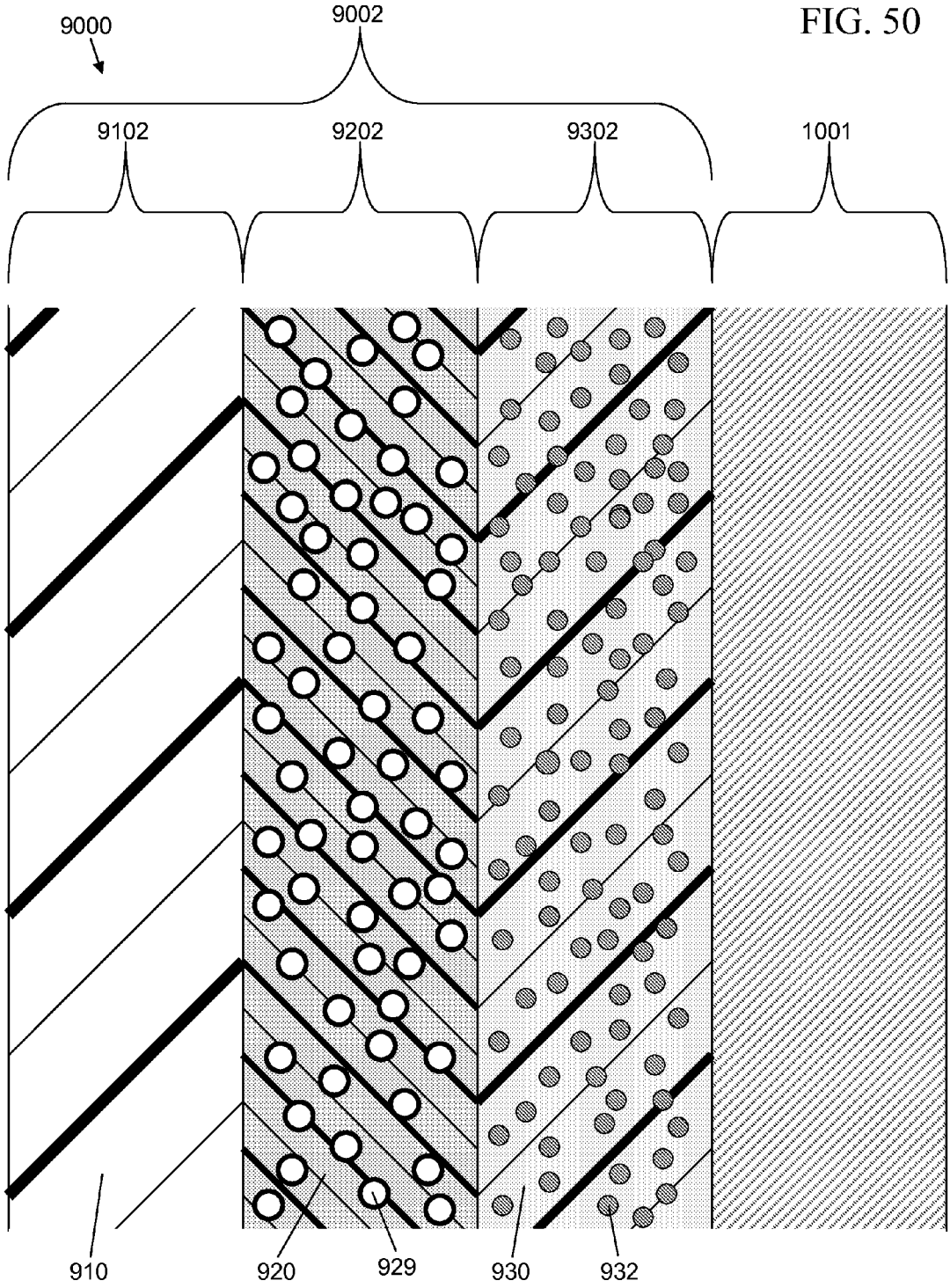
FIG. 50 is a cross-sectional view of a four-layer material armor system in accordance with the present invention. As compared with FIG. 51 and FIG. 52.
Figure 51:
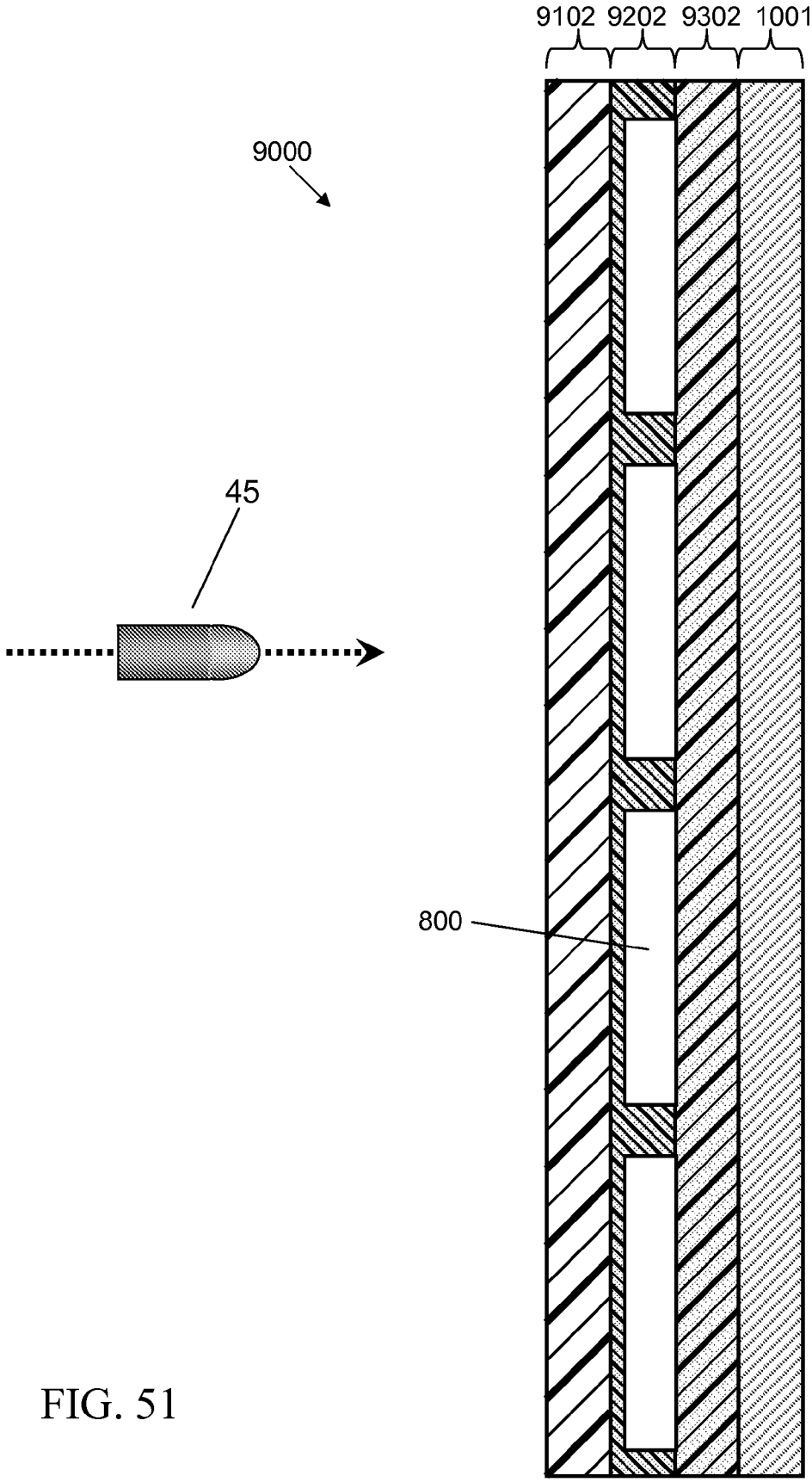
FIG. 51 is a cross-sectional view illustrating implementation of conventional ceramic elements in an inventive four-layer material armor system such as shown in FIG. 50.
Figure 52:
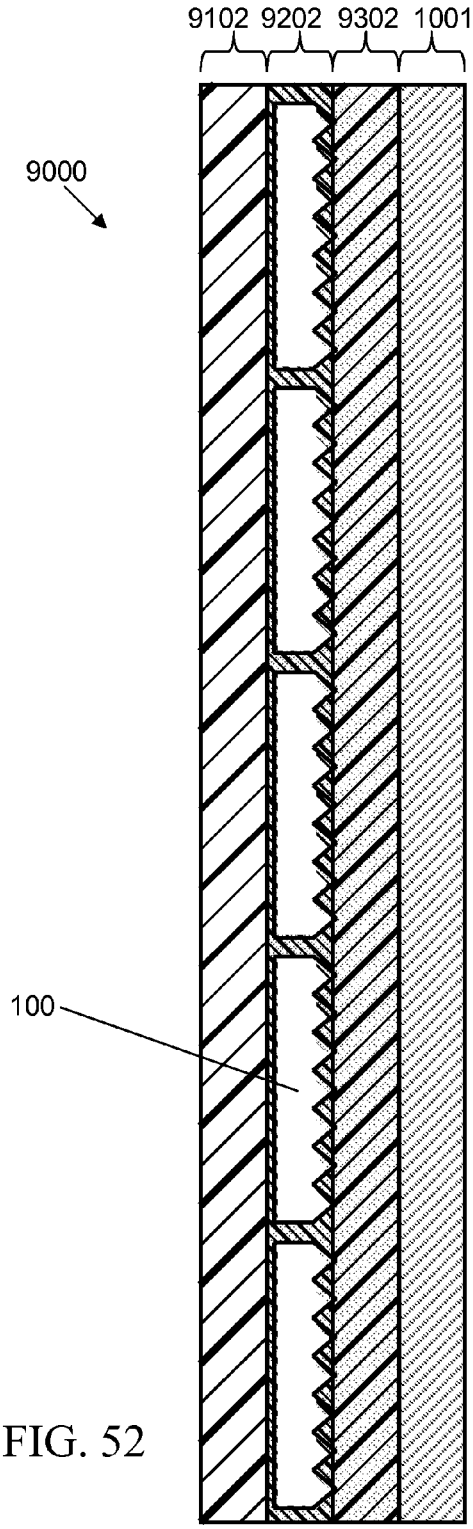
FIG. 52 is a cross-sectional view illustrating implementation of inventive first-mode ceramic elements in an inventive four-layer material armor system such as shown in FIG. 50.
Figure 53:
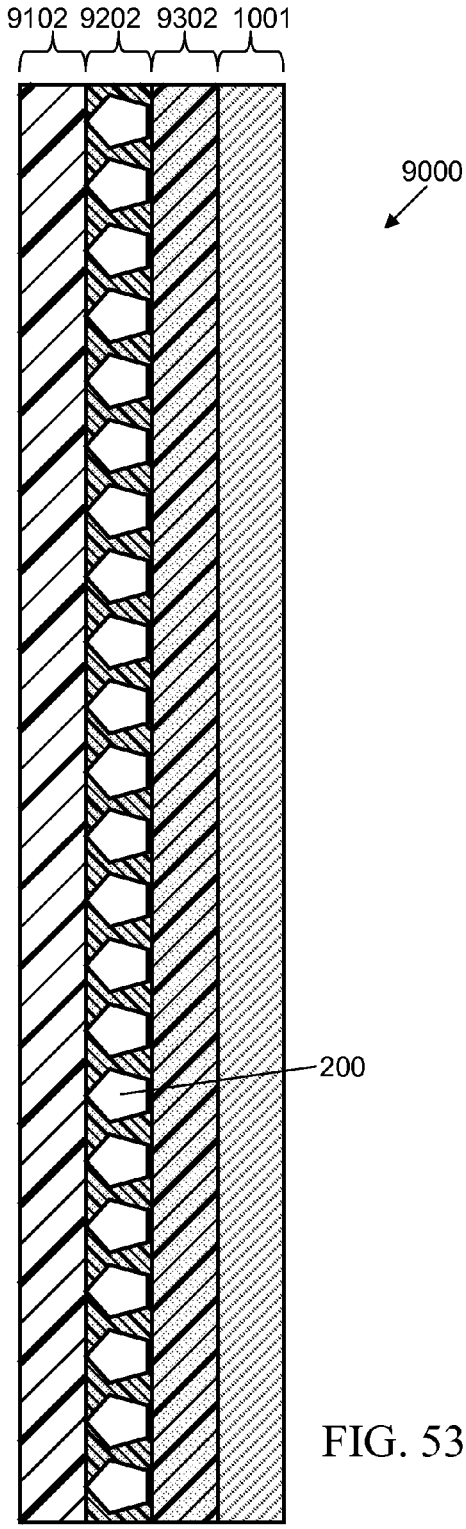
FIG. 53 is a cross-sectional view illustrating implementation of inventive second-mode ceramic elements in an inventive four-layer material armor system such as shown in FIG. 50.

The solid particulate quality of polymeric material 930 shown in FIG. 50 enhances coupling of the ceramic elements to the backing. This is particularly propitious when the ceramic elements are inventive first-mode ceramic elements 100, which have a textured back face 120. Generally, an adulterated (particle-filled) polymeric material would represent a bonding material characterized by higher stiffness (acoustic impedance) than would an unadulterated (un-filled) polymeric material.

Figure 54:
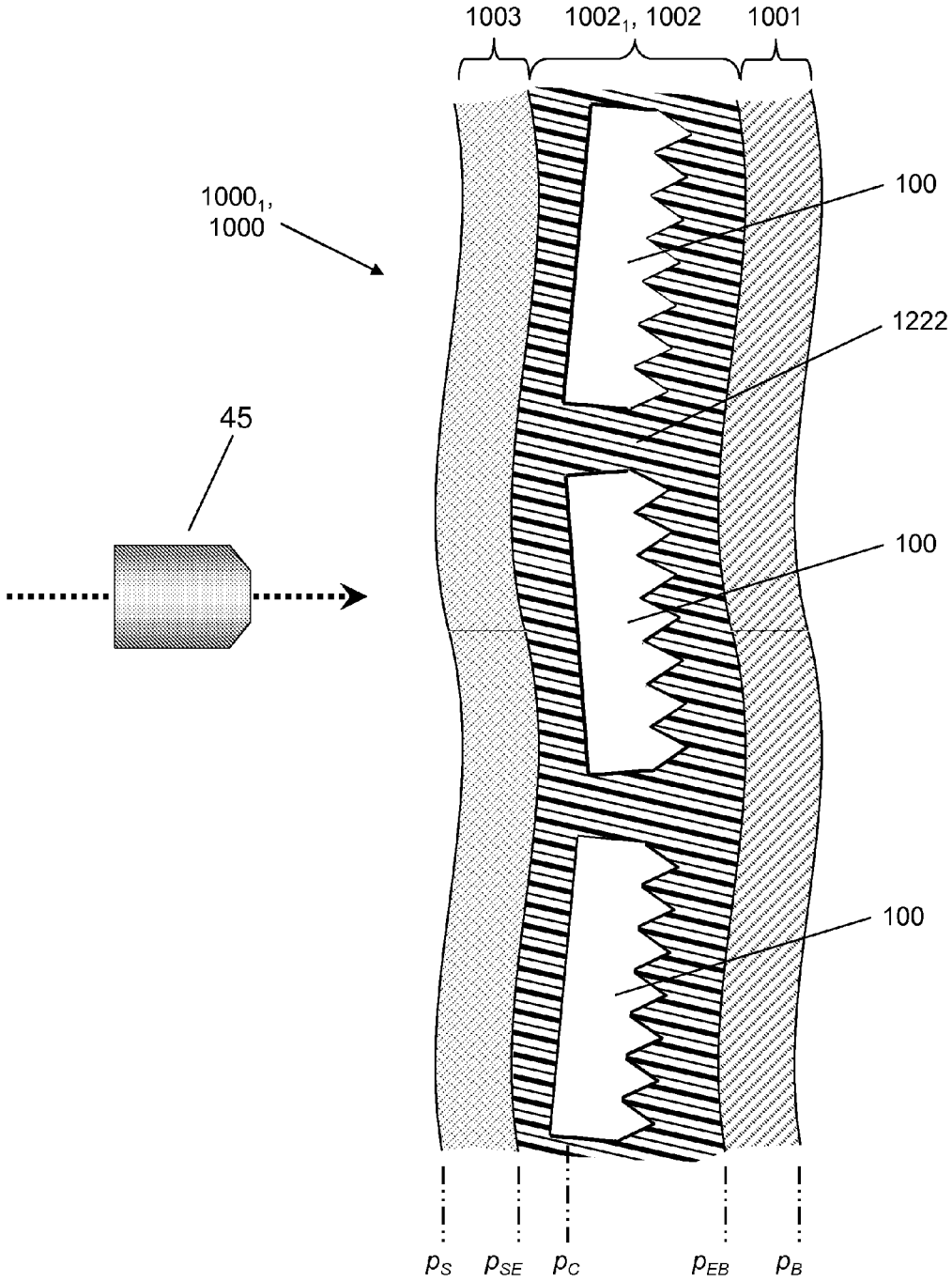
FIG. 54 is a side cross-sectional view of a three-layer material armor system in accordance with the present invention. The inventive embodiment shown in FIG. 54 is similar to the inventive embodiment shown in FIG. 42, wherein inventive first-mode geometric ceramic elements are contained in the intermediate layer. The inventive embodiment shown in FIG. 54 is shown to be characterized by curvature for conformally coupling with an object that is characterized by curvature.

Inventive plural-layer armor systems are not necessarily embodied so as to have an entirely linear (straight) character, such as illustrated in FIG. 42 through FIG. 45 and FIG. 51 through FIG. 53. Inventive practice encompasses inventive plural-layer armor systems that are partially or entirely curved in order to fit the contour or curvature of an entity such as a land vehicle or a ship. Now referring to FIG. 54, inventive plural-layer armor systems can be embodied so as to have a curved or curvilinear character in one direction or plural directions or all directions. FIG. 54 is intended to be illustrative of curvature of an inventive armor system $\mathbf{1000}_1$, but is not intended to suggest any particular application thereof. Similarly as exhibited by the straight geometric planes shown in FIG. 42, the curved geometric planes shown in FIG. 54 are parallel to each other.

As illustrated in FIG. 54, curved geometric plane $p_C$ (described by the respective front faces of the ceramic elements 100), curved geometric plane $p_S$ (described by the front surface of spall-containment layer 1003), curved geometric plane $p_{SE}$ (described by the back surface of spall-containment layer 1003, and by the front surface of ceramic-embedded elastomeric matrix material layer $\mathbf{1002}_1$), curved geometric plane $p_{EB}$ (described by the back surface of ceramic-embedded elastomeric matrix material layer 1002$_1$, and by the front surface of backing layer 1001), and curved geometric plane $p_B$ (described by the back surface of backing layer 1001), are parallel to each other. Curved geometric plane $p_C$ is described in an approximative manner by the front faces of the ceramic elements 100. The straight front faces of ceramic elements 100 tend to be parallel to the straight geometric tangents of the corresponding curved portions of the other curved geometric planes, e.g., curved geometric plane $p_{SE}$.

The term "geometric plane," as used herein specifically to indicate geometries relating to armor system layering (e.g., surfaces or interfaces of layers) or ceramic-inclusive element arrayal (e.g., front points or front surfaces of ceramic-inclusive elements of an array) in the context of inventive practice of plural-layer armor systems, broadly refers to a geometric plane that is straight in all directions or that is at least partially curved in at least one direction. Otherwise expressed, a "geometric plane," in this specialized usage of the term, can be characterized by complete linearity, or by some degree of linearity and some degree of curvilinearity, or by complete curvilinearity. Regardless of the degree of curvature, if any, of an inventive armor system, its system layering and ceramic-inclusive element arrayal are configured so as to generally manifest parallelness, which can be expressed in terms of corresponding geometric planes.

Certain ceramic materials are known in the art to be suitable for use in armor applications. These conventional armor ceramics—which include aluminum oxide (commonly called "alumina"), silicon carbide, boron carbide, and titanium carbide—have been developed over the last thirty years or so, and represent the current state of the art. Inventive ceramic elements 100, 200, and 300 can each be made of any one, or any combination, of these "tried-and-true" conventional ceramic armor materials, with ceramic material preferences varying in accordance with particular inventive embodiments and applications. As alternatives to conventional ceramic materials, new materials may be suitable, and even advantageous, for some embodiments of the present invention. Inventive practice, such as of inventive armor systems 1000 and 9000, lends itself to use of diverse "ceramic-inclusive" materials.

One possibility for inventive practice of the inventive geometric ceramic elements, as an alternative to the above-mentioned conventional ceramic materials, is an aluminosilicate porcelain material. One of the present inventors, Curtis A. Martin, along with some colleagues of his, has investigated the possibility of using aluminosilicate porcelain as a ceramic armor material. Heretofore in conventional practice the above-noted conventional pure ceramic materials (aluminum oxide, silicon carbide, boron carbide, titanium carbide, etc.) have been relied upon for armor applications. Use of aluminosilicate porcelain is not known in the armor-related arts, as it has always been dismissed as an insufficiently strong ceramic material for use in armor applications.

Aluminosilicate porcelain has a density of 2.4 g/cm$^3$, significantly less than the densities of: silicon carbide (3.2 g/cm$^3$); 90% alumina (high alumina porcelain) (3.6 g/cm$^3$); 99% alumina (3.95 g/cm$^3$); and, titanium diboride (4.5 g/cm$^3$). Because it is advantageous in terms of weight, cost and availability, present inventor Martin believes that aluminosilicate porcelain may be worthy of consideration, generally, as an alternative ceramic armor material to the conventional ones.

Present inventor Martin and colleagues have demonstrated that aluminosilicate porcelain elements can be efficaciously implemented as embedded in an elastomeric layer of a plural-layer composite armor material system. They assembled four experimental armor systems in which conventionally shaped (rectangular flat plate) tiles were embedded in elastomeric matrix material adjacent to steel (rolled homogeneous armor, or "RHA") backing material. Each armor system was tested under identical circumstances in a ballistic range using a 20 mm fragment-simulating projectile. The four armor systems were made so as to be characterized by equal areal densities of the respective ceramic elements, wherein areal density was defined as mass per unit area measured in the frontal geometric plane of the armor system.

In the first armor system, aluminosilicate porcelain tiles arrayed in a single geometric plane were embedded in an elastomeric matrix layer adjacent to a steel backing layer. In the second armor system, aluminosilicate porcelain tiles arrayed in two parallel geometric planes were embedded in an elastomeric matrix layer adjacent to a steel backing layer. In the third armor system, 90% aluminum oxide tiles arrayed in a single geometric plane were embedded in an elastomeric matrix layer adjacent to a steel backing layer. In the fourth armor system, 99% aluminum oxide tiles arrayed in a single geometric plane were embedded in an elastomeric matrix layer adjacent to a steel backing layer.

Since the four armor systems were designed to have equal areal densities of the respective ceramic tiles, the thicknesses of the ceramic tiles and corresponding elastomeric matrix layers were rendered differently in accordance with the different physical densities of the ceramic tiles. That is, the 90% alumina tiles and corresponding elastomeric matrix layer of the third armor system were slightly thicker than the 99% alumina tiles and corresponding elastomeric matrix layer of the fourth armor system. The aluminosilicate porcelain tiles and two corresponding elastomeric matrix layers of the second armor system were significantly thicker than the 90% alumina tiles and corresponding elastomeric matrix layer of the third armor system; similarly, the, aluminosilicate porcelain tiles and single corresponding elastomeric matrix layer of the first armor system were significantly thicker than the 90% alumina tiles and corresponding elastomeric matrix layer of the third armor system.

The ballistic performances of the four armor systems were tested and compared in terms of "$V_{50}$," which was defined as the velocity at which 50% of the projectiles impacting an armor system at its frontal side will be stopped by the armor system. Velocity $V_{50}$ was normalized to a maximum value of one hundred. It was demonstrated that the first and second armor systems (i.e., the two armor systems implementing aluminosilicate porcelain tiles) exhibited performances comparable to those of the third and fourth armor systems (i.e., the two armor systems implementing alumina tiles). The first, third and fourth armor systems obtained respective Velocity $V_{50}$ scores of approximately 100. The second armor system obtained a Velocity $V_{50}$ score of approximately 95. The somewhat lower Velocity $V_{50}$ score for the second armor system's double-layer aluminosilicate porcelain tile-embedded matrix system may suggest some configurational superiority thereto of the first armor system's single-layer aluminosilicate porcelain tile-embedded matrix system.

It was thus experimentally demonstrated that lower density ceramic material can be used in these kinds of armor systems, with effectiveness equal to that of conventional ceramic materials, by providing a thicker overall ceramic-embedded matrix layer at the same areal density of the ceramic material (which is tantamount to saying at the same mass or weight of the ceramic material). The increased thickness of the aluminosilicate porcelain ceramic-embedded matrix layer compensates for the lesser intrinsic ballistic armor effectiveness of aluminosilicate porcelain material as compared with conventional armor ceramic materials.

Another intriguing and innovative possibility for inventive practice, conceived and investigated by present inventor Curtis A. Martin and colleagues, is a two-phase composite ceramic material composition consisting of chromium diboride and aluminum oxide.

By way of background, it was demonstrated several years ago that a two-phase composite ceramic material composition consisting of titanium diboride and aluminum oxide can exhibit enhanced ballistic resistance, as compared with ballistic resistance exhibited by aluminum oxide alone; see Gary A. Gilde et al., "Processing Aluminum Oxide/Titanium Diboride Composites for Penetration Resistance," *Ceramic Engineering and Science Proceedings*, volume 22, number 3, pages 331-342 (2001), incorporated herein by reference. A significant drawback of the titanium diboride-aluminum oxide composite material disclosed by Gilde et al. is the necessity to prepare this composition by hot pressing, thus limiting practical application due to reduced production capacity and higher production cost.

It was previously demonstrated that a two-phase composite ceramic material composition consisting of chromium diboride and aluminum oxide possesses enhanced mechanical properties, as compared with mechanical properties of chromium diboride alone or of aluminum oxide alone; see Inna G. Talmy et al., "Ceramics in the CrB2-Al2O3 System," *Ceramic Transactions*, volume 74, pages 261-272 (1996), incorporated herein by reference. Talmy et al. disclose an increase in toughness and hardness in various "intermediate" compositions of chromium diboride-aluminum oxide, as compared with pure aluminum oxide or pure chromium diboride.

Both Talmy et al. and Gilde et al. disclose the making of their respective ceramic-ceramic composite materials via hot pressing. In general, the necessity to prepare a composition by hot pressing represents a significant drawback of that composition, as this limits practical application because of reduced production capacity and higher production cost. There is an advantage of the chromium diboride-aluminum oxide composition disclosed by Talmy et al., vis-à-vis the titanium diboride-aluminum oxide composition disclosed by Gilde et al., namely, because of limited solid solubility in a chromium diboride-aluminum oxide system, the hot pressing temperature is reduced as compared with that of a titanium diboride-aluminum oxide system. Notwithstanding possible cost-saving advantage of lower hot pressing temperature, as a practical matter neither Talmy et al's chromium diboride-aluminum oxide material nor Gilde et al.'s titanium diboride-aluminum oxide material holds significant promise for armor applications.

A significant advantage, recently discovered by present inventor Martin along with Inna G. Talmy and James Zaykoski, is the fact that some compositions of chromium diboride-aluminum oxide—especially, those that consist predominantly of aluminum oxide—can be pressureless sintered. Generally speaking, pressureless sintering is a less expensive processing methodology than hot pressing. With its promise of reduced cost and increased availability, Martin, Talmy, and Zaykoski's chromium diboride-aluminum oxide materials manufactured via pressureless sintering has greater potential than many materials manufactured via hot pressing. By virtue of this processing improvement (i.e., pressureless sintering production vice hot pressing production) and its favorable mechanical properties, a pressureless sintered chromium diboride-aluminum oxide system is an attractive material for use as armor (e.g., ballistic armor) ceramic, particularly in lieu of hot pressed materials.

The afore-noted conventional ceramic armor materials (e.g., aluminum oxide, silicon carbide, boron carbide, titanium carbide) represent pure ceramic materials. The afore-noted unconventional ceramic armor material (aluminosilicate porcelain), as well, represents a pure ceramic material. The afore-noted chromium diboride-aluminum oxide composition represents a completely ceramic composite material system consisting of two different pure ceramic material phases. Inventive practice does not require that the inventive ceramic elements be composed of a pure ceramic material or a completely ceramic composite material. Instead, according to inventive practice, the inventive ceramic elements can be composite articles that consist of at least one ceramic material and at least one non-ceramic material.

Although the present invention is typically practiced whereby the inventive ceramic elements are made of conventional ceramic armor material, inventive practice permits a wide variety of ceramic-inclusive material compositions for the inventive ceramic elements. The term "ceramic-inclusive material," as used herein, denotes any material that includes at least one ceramic material. Generally as defined herein, a ceramic-inclusive material can fall into any of three categories, viz., (a) a ceramic material, (b) a ceramic-ceramic composite material, and (c) a ceramic-non-ceramic composite material. A ceramic material consists of a "pure" ceramic material, i.e., a single, completely ceramic material. A ceramic-ceramic composite material consists of at least two different ceramic materials. A ceramic-non-ceramic composite material consists of at least one ceramic material and at least one non-ceramic material. For instance, a ceramic-ceramic composite material can consist of three different ceramic materials. As another example, a ceramic-non-ceramic composite material can consist of two different ceramic materials and two different non-ceramic materials. And so on . . . .

In the realm of ceramic-non-ceramic composite materials, joint inventor Martin has conceived interesting possibilities of using, for ballistic armor applications, various types of composites that combine ceramic materials with metal materials, glass materials, and/or polymeric materials. Conventional ceramic armor materials do not lend themselves to preparation in complex shapes. In contrast, according to joint inventor Martin's conceptions, a reaction-bonded ceramic material such as reaction-bonded silicon nitride (RBSN) is prepared rather easily in a complex shape such as a helmet shape or vest shape, and the specially shaped reaction-bonded ceramic (e.g., RBSN) preform is then readily infiltrated with at least one selected non-ceramic infiltrator material from among one or more of three categories of non-ceramic infiltrator material, viz., (i) metal, (ii) polymeri (e.g., elastomer), and (iii) glass. Advantageously, such a ceramic-non-ceramic composite of Martin can exhibit reduced density, and therefore reduced weight, because it is constituted as if part of the ceramic material has been replaced with less dense material; in effect, a metal (especially, a light metal such as aluminum), a polymer (e.g., elastomer), or a glass has been substituted for a portion of the total volume of the ceramic.

Techniques are known for making certain kinds of ceramic-metal composites. One previously disclosed methodology for creating a ceramic-metal composite involves the combination of ceramic powder with a metal component through dispersion of ceramic powder into the melted metal component. Another previously disclosed methodology for preparing a ceramic-metal composite involves the partial sintering of ceramic material to obtain a porous ceramic body, followed by melt infiltration of the porous ceramic body with a metal.

The following United States patents, incorporated herein by reference, are instructive on methods for making ceramic-metal composite materials: Claussen et al. U.S. Pat. No. 6,573,210 B1 issued 3 Jun. 2003; Claussen et al. U.S. Pat. No. 6,051,277 issued 18 Apr. 2000; Claussen et al. U.S. Pat. No. 6,025,065 issued 15 Feb. 2000; Claussen U.S. Pat. No. 5,843,859 issued 1 Dec. 1998; Claussen U.S. Pat. No. 5,607,630 issued 4 Mar. 1997; Claussen U.S. Pat. No. 5,326,519 issued 5 Jul. 1994; Claussen et al. U.S. Pat. No. 5,158,916 issued 27 Oct. 1992; Claussen et al. U.S. Pat. No. 4,908,171 issued 13 Mar. 1990; Claussen et al. U.S. Pat. No. 4,900,492 issued 13 Feb. 1990; Claussen et al. U.S. Pat. No. Re. 32,449 reissued 30 Jun. 1987; Claussen et al. U.S. Pat. No. 4,525,464 issued 25 Jun. 1985; Aghajanian et al. U.S. Pat. No. 7,197,972 B2 issued 3 Apr. 2007; Benitsch U.S. Pat. No. 7,128,963 B2 issued 31 Oct. 2006; Aghajanian et al. U.S. Pat. No. 7,104,177 B1 issued 12 Sep. 2006; Aghajanian et al. U.S. Pat. No. 6,995,103 B2 issued 7 Feb. 2006; Aghajanian et al. U.S. Pat. No. 6,862,970 B2 issued 8 Mar. 2005; Karandikar et al. U.S. Patent Application Publication No. 2004/0238794 A1 published 2 Dec. 2004; McCormick et al. U.S. Pat. No. 6,805,034 B1 issued 19 Oct. 2004; McCormick et al. U.S. Pat. No. 6,609,452 B1 issued 26 Aug. 2003.

The following two references disclose RBSN-metal composites. Nils Claussen et al., "Squeeze Cast $\beta$-$Si_3N_4$—Al Composites," *Advanced Engineering Materials*, volume 4, number 3, pages 117-119 (2002), incorporated herein by reference, disclose infiltration (referred to by Claussen et al. as "squeeze casting") of a conventional aluminum alloy into a porous reaction-bonded silicon nitride ($Si_3N_4$) preform to produce a $\beta$-$Si_3N_4$—Al composite exhibiting excellent mechanical properties. N. A. Travitzky and N. Claussen, "Microstructure and Properties of Metal Infiltrated RBSN Composites," *Journal Of The European Ceramics Society*, volume 9, number 1, pages 61-65 (1992), incorporated herein by reference, disclose gas-pressure infiltration of RBSN with one of four different metallic materials—viz., aluminum (Al), with an aluminum alloy (Al—Mg—Si—Zn), titanium-aluminum (Ti—Al) intermetallic, and silicon (Si)—thus producing four different RBSN-metal composites.

A reaction-bonded silicon nitride (RBSN) "preform" can be prepared by forming a "green body" of silicon particles (e.g., by pressing or slip-casting), and then reacting the green body with nitrogen or nitrogen-bearing gas (such as ammonia), resulting in conversion of silicon particles to silicon nitride grains. The RBSN material perform thus produced is necessarily porous; it can never be pore-free (fully dense). It is possible to control the porosity (and therefore the density) of the RBSN by controlling the "green density."

Claussen et al., *Advanced Engineering Materials*, prepared aluminum-silicon nitride composites, measured flexural strengths, and found that flexural strength was dramatically increased by infiltration of $Si_3N_4$ with Al. Present inventor Martin has conceived the infiltration into RBSN preforms of non-ceramic materials such as polymeric materials or glass materials. It is believed by Martin that the infiltration of such materials into RBSN preforms will yield similar increases in flexural strength. Moreover, regardless of whether the porosity of RBSN is filled with a metal, a glass, or a polymer, a pore-free material would result, having a lower overall density than fully dense silicon nitride, and having a significantly lower density than alumina.

Present inventor Martin believes that RBSN materials hold promise for armor applications. The silicon nitride grains in RBSN are interlocked and well-bonded; in fact, the bonding between the grains in RBSN is stronger than that of partially sintered ceramics. Based on the varying strengths for varying porosities of RBSN as reported by the afore-noted Claussen et al., *Advanced Engineering Materials*, the flexural strength of porous RBSN with more than 40% porosity can be over 250 Mpa, which is as strong as fully dense 90% alumina, a common armor material.

Accordingly, present inventor Martin's novel lightweight ceramic-non-ceramic-infiltrated RBSN preform composite materials, and novel methods of making same, are believed to be suitable for ballistic armor applications. Featured by Martin's new ceramic-non-ceramic composite materials is the infiltration of a metallic material and/or a polymeric material and/or a glass material into a reaction-bonded porous ceramic such as a reaction-bonded silicon nitride ("RBSN"). More specifically, previously unknown are Martin's RBSN-glass composites, RBSN-polymer composites, RBSN-glass-polymer composites, RBSN-metal-polymer composites, RBSN-metal-glass composites, and RBSN-metal-polymer-glass composites.

Infiltration of a reaction-bonded ceramic preform can be accomplished without great difficulty. To make a ceramic-metal-infiltrated RBSN preform composite, the impregnation of RBSN by a metal can be accomplished via pressure melt infiltration of a metallic (metal or metal alloy) material. Pressureless melt infiltration may be possible with the right surface chemistry. To make a polymer-metal-infiltrated RBSN preform composite, the impregnation of RBSN by a polymer can be accomplished via melt infiltration or vacuum/pressure infiltration of a thermoset polymeric material. To make a polymer-glass-infiltrated RBSN preform composite, the impregnation of RBSN by a glass can be accomplished via melt infiltration of a glass material.

The unique ceramic-non-ceramic-infiltrated RBSN preform composite—e.g., a ceramic-metal infiltrated RBSN preform composite or a ceramic-polymer infiltrated RBSN preform composite or a ceramic-glass infiltrated RBSN preform composite—may be particularly suitable for light weight armor applications (such as personal/personnel armor applications, e.g., body armor or armored helmets) for which weight is critical but at the same time the need exists to increase the level of protection to cover more aggressive fragments and other projectiles. Currently, ground troops are outfitted with a polymer composite helmet that is capable of stopping handgun threats.

In theory, a helmet made of a ceramic material could provide greater resistance to projectile impact than what is currently used. In practice, however, helmets represent especially difficult applications for ceramic armor because of both weight restriction and specialized shape. Ceramic armor materials of more advanced capability are prepared most often by hot pressing, a method that is not suitable for preparation of an article of complex shape such as a helmet. By comparison, reaction bonded silicon nitride can be prepared easily in a helmet shape, as evidenced by the current production of automotive turbocharger rotors and jet engine components. The helmet-shaped RBSN perform can be readily infiltrated with the selected (e.g., metal, polymer, or glass) material.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications, and changes to the principles disclosed herein may be made by one skilled in the art without departing from the true scope and spirit of the present invention, which is indicated by the following claims.

What is claimed is:

1. A plural-layer composite armor system comprising a ceramic-embedded elastomeric matrix layer and a rigid backing layer, the ceramic-embedded elastomeric matrix layer including an elastomeric matrix material and plural spaced ceramic elements embedded in the elastomeric matrix layer, each ceramic element having a pyramidal front section and a prismoidal body section, the pyramidal front section and the prismoidal body section sharing a polygonal junction, the pyramidal front section having an apex, the prismoidal body section having a two-dimensionally textured back face, the two-dimensionally textured back face characterized by an at least substantially regular pattern of plural protuberances and a recessed surface, the protuberances at least substantially arranged in parallel rows and parallel columns perpendicular to the parallel rows, the ceramic elements arrayed so that the corresponding apexes are at least approximately situated in the same geometric plane, wherein the two-dimensionally textured back face is characterized by an at least substantially regular pattern of plural curved protuberances and a recessed surface, each curved protuberance being at least substantially characterized by curvature.

2. The plural-layer composite armor system of claim 1 wherein:

the ceramic-embedded elastomeric matrix layer further includes solid particulate filler material;

the rigid backing layer is composed of a rigid material selected from the group consisting of metallic material and fiber-reinforced polymer matrix material;

the ceramic elements are coupled to the rigid backing layer so that the corresponding back faces are adjacent to the rigid backing layer.

3. The plural-layer composite armor system of claim 1 further comprising a spall-containment layer, wherein the ceramic-embedded elastomeric matrix layer is situated between the spall-containment layer and the rigid backing layer.

4. The plural-layer composite armor system of claim 1 wherein, when shock waves result from the forceful striking by a projectile of the plural-layer composite armor system at the pyramidal front section:

attenuation of the shock waves is associated with the non-parallel geometric character of the ceramic element;

the shock waves include incident shock waves and reflected shock waves;

the incident shock waves are generated by said forceful striking;

the reflected shock waves are generated by reflection of the incident shock waves from at least one interface defined by the prismoidal body section with the elastomeric matrix material;

the attenuation includes divergence, both spatial and temporal, of the incident shock waves and the reflected shock waves.

5. The plural-layer composite armor system of claim 1 wherein the prismoidal body section is characterized by a geometric shape selected from the group consisting of prism and truncated pyramid.

6. A plural-layer composite armor system comprising a ceramic-embedded elastomeric matrix layer and a rigid backing layer, the ceramic-embedded elastomeric matrix layer including an elastomeric matrix material and plural spaced ceramic elements embedded in the elastomeric matrix layer, each ceramic element having a pyramidal front section and a prismoidal body section, the pyramidal front section and the prismoidal body section sharing a polygonal junction, the pyramidal front section having an apex, the prismoidal body section having a two-dimensionally textured back face, the two-dimensionally textured back face characterized by an at least substantially regular pattern of plural protuberances and a recessed surface, the protuberances at least substantially arranged in parallel rows and parallel columns perpendicular to the parallel rows, the ceramic elements arrayed so that the corresponding apexes are at least approximately situated in the same geometric plane, wherein:

the geometric plane is a first geometric plane;

the corresponding textured back faces are generally situated in a second geometric plane;

the corresponding polygonal junctions are at least approximately situated in a third geometric plane;

the first geometric plane, second geometric plane, and third geometric plane are at least approximately parallel to each other;

the two-dimensionally textured back face is characterized by an at least substantially regular pattern of plural curved protuberances and a recessed surface, each curved protuberance being at least substantially characterized by curvature.

* * * * *